US011950681B2

(12) United States Patent
Niemeyer et al.

(10) Patent No.: US 11,950,681 B2
(45) Date of Patent: Apr. 9, 2024

(54) DEVICE FOR DISPENSING A COMPOUND

(71) Applicant: RPC Bramlage GmbH, Lohne (DE)

(72) Inventors: Jessica Niemeyer, Lohne (DE); Lea Hammersen, Lohne (DE); Ellen Seyda, Lohne (DE)

(73) Assignee: RPC Bramlage GmbH, Lohne (DE)

( * ) Notice: Subject to any disclaimer, the term of this patent is extended or adjusted under 35 U.S.C. 154(b) by 234 days.

(21) Appl. No.: 17/618,040

(22) PCT Filed: Jun. 15, 2020

(86) PCT No.: PCT/EP2020/066468

§ 371 (c)(1),
(2) Date: Dec. 10, 2021

(87) PCT Pub. No.: WO2020/249816

PCT Pub. Date: Dec. 17, 2020

(65) Prior Publication Data

US 2022/0304451 A1 Sep. 29, 2022

(30) Foreign Application Priority Data

Jun. 13, 2019 (GB) ..... 1908465
Nov. 19, 2019 (GB) ..... 1916839

(51) Int. Cl.
*A45D 40/04* (2006.01)
*B65D 83/00* (2006.01)
(Continued)

(52) U.S. Cl.
CPC ..... *A45D 40/04* (2013.01); *B65D 83/0005* (2013.01); *B65D 83/0011* (2013.01); *A45D 2040/0043* (2013.01); *A45D 2040/208* (2013.01)

(58) Field of Classification Search
CPC ..... A45D 40/04; A45D 2040/0043; A45D 2040/208; B65D 83/0005; B65D 83/0011
See application file for complete search history.

(56) References Cited

U.S. PATENT DOCUMENTS 5,868,510 A 2/1999 Lacout et al.
6,089,774 A 7/2000 Franken et al.
(Continued)

FOREIGN PATENT DOCUMENTS

DE 199 21 662 A1 11/2000
EP 0 713 660 A1 5/1996
(Continued)

OTHER PUBLICATIONS

International Search Report of PCT/EP2020/066468, dated Feb. 19, 2021.

*Primary Examiner* — Jennifer C Chiang
(74) *Attorney, Agent, or Firm* — Collard & Roe, P.C.

(57) ABSTRACT

A device to dispensing a compound has a movable support arranged in a device housing in order to act on the compound, and a rotary handle in order to move the support between a lower starting position and a maximum upper extended position of the support. The handle has a spindle which can be rotated about a longitudinal axis provided in the movement direction of the support. A spindle nut is additionally provided on the support. The spindle nut has a length in the direction of the longitudinal axis, the length being greater than the distance between the lower starting position and the maximum upper extended position in the movement direction of the support. According to another solution, a combination of the support, the spindle, and the compound can be inserted into the device housing from the top for connecting to the rotary handle.

10 Claims, 21 Drawing Sheets

(51) Int. Cl.
*A45D 40/00* (2006.01)
*A45D 40/20* (2006.01)

(56) References Cited

U.S. PATENT DOCUMENTS

| | | | | |
|---|---|---|---|---|
| 7,270,495 | B1 | 9/2007 | Preteroti | |
| 8,961,053 | B1 | 2/2015 | Esposito | |
| 11,490,708 | B2 * | 11/2022 | Groffsky | B65D 83/0038 |
| 2013/0028649 | A1 * | 1/2013 | Kobayashi | A45D 40/04 401/61 |
| 2013/0193167 | A1 | 8/2013 | Arora et al. | |

FOREIGN PATENT DOCUMENTS

| | | | |
|---|---|---|---|
| EP | 0 813 829 | A1 | 12/1997 |
| EP | 2 052 640 | B1 | 2/2015 |
| FR | 968384 | A | 11/1950 |
| FR | 3 025 408 | A1 | 3/2016 |
| JP | S48-95883 | U | 11/1973 |
| JP | 3113855 | U | 9/2005 |
| WO | 95/28857 | A1 | 11/1995 |
| WO | 2010/072670 | A1 | 7/2010 |

* cited by examiner

1

X
2
K
23
22
3
6
4
X x
1
9
5
K
2
22
12
23
3
10
6
7
11
17
8
16
19
24
43
44
XI
14
25
45
62
4
27
61
x x
1
5
3
6
52
x
4

1
x
5
K
2
3
r
12
6
11
7
17
8
53
15
55
38
14
51
59
58
x
56
39
60
XXV

DEVICE FOR DISPENSING A COMPOUND

CROSS REFERENCE TO RELATED APPLICATIONS

This application is the National Stage of PCT/EP2020/066468 filed on Jun. 15, 2020, which claims priority under 35 U.S.C. § 119 of British Application No. 1908465.6 filed on Jun. 13, 2019 and British Application No. 1916839.2 filed on Nov. 19, 2019, the disclosures of which are incorporated by reference. The international application under PCT article 21(2) was not published in English.

TECHNICAL FIELD

The invention pertains to a device for dispensing a compound, wherein a movable support is arranged in a device housing in order to act upon the compound, wherein a rotary handle furthermore is provided in order to move the support between a lower starting position and a maximally extended upper position of the support, wherein said rotary handle has a spindle that is rotatable about a longitudinal axis extending in the moving direction of the support, and wherein a spindle nut furthermore is provided on the support.

The invention also pertains to a device for dispensing a compound, wherein a movable support is arranged in a device housing in order to act upon the compound, wherein a rotary handle furthermore is provided in order to move the support between a lower starting position and a maximally extended upper position of the support, wherein said rotary handle has a spindle that is rotatable about a longitudinal axis extending in the moving direction of the support, wherein a housing bottom furthermore is formed on the device housing and the rotary handle interacts with the housing bottom in an interlocking yet overrunnable manner in order to stably maintain a rotational position, and wherein the housing bottom furthermore has a lower surface.

PRIOR ART

Devices of the type in question are known, for example, from the field of cosmetics. Such a device may be realized, for example, in the form of a deodorant stick with a preferably solid compound that is supported on the support of the device in the device housing and can be moved into a position, in which it protrudes beyond an opening of the device housing, with the aid of the spindle formation by using the rotary handle. The device particularly can be used in this protruding position. The compound can be moved into a non-usage position, in which it is retracted into the device housing in the direction of the lower starting position of the support, as a result of a reverse movement of the spindle.

With respect to the relevant prior art, we refer, for example, to U.S. Pat. No. 7,270,495 B1 or also to EP 2 052 640 B1.

SUMMARY OF THE INVENTION

In light of the above-described prior art, an objective of the invention can be seen in advantageously designing a device of the type in question.

According to a first inventive idea, this objective is potentially attained with a device, in which it is proposed that the spindle nut has in the direction of the longitudinal axis a length that is equal to or greater than the distance between the lower starting position and the maximally extended upper position in the moving direction of the support.

As a result of the proposed design, it is possible to essentially design and arrange the spindle and the spindle nut in a region underneath the support (with respect to a normal standing position of the device on a plane surface, in which the opening of the device housing for exposing the compound is directed upward). The spindle and the spindle nut act telescopically in the course of a movement of the support along the longitudinal axis, wherein it is furthermore preferred that a maximum overlap of the spindle and the spindle nut in the direction of the longitudinal axis is realized in the preferably stop-limited lower starting position of the support. Furthermore, it is thereby advantageously possible to design the spindle in the direction of its longitudinal axis such that it does not or not substantially extend beyond the support in the direction of the compound. It is respectively preferred that the spindle does not or not substantially penetrate the compound or that the spindle does not or not substantially protrude into the compound. This proves particularly advantageous with respect to so-called refill devices, in which consumed compound can be replenished with fresh compound by placing a refill pack on the support. The fresh compound does not have to be provided with a substantial opening for a protruding spindle section. Due to the proposed solution, it would also be possible that the compound seated on the support is not in direct contact with the spindle, which rotates about the longitudinal axis in the course of the actuation of the rotary handle.

In this context, the length of the spindle nut preferably refers to only a section of the spindle nut, which in the lower starting position is in threaded engagement with the spindle or in any case encompasses the threaded regions of the spindle. In the lower starting position, the spindle may extend as far as the support or optionally also beyond the support by a comparably smaller length section.

According to another inventive idea, the above-defined objective is potentially also attained with a device, in which it is proposed that a combination consisting of the support, the spindle and the compound can be inserted into the device housing from above in order to be connected to the rotary handle.

In this way, the combination can be advantageously used as a refill pack in a so-called refillable device. The support, the spindle and the compound respectively are components of the refill pack or form this refill pack such that the support with the spindle can be disposed or optionally recycled once the compound has been consumed. The device preferably is filled with this combination from above and accordingly through the opening of the device, which is already provided in the device for dispensing the compound. The rotary handle preferably remains part of the repeatedly usable device housing. In this context, the rotary handle may remain retained on the device housing in the course of an exchange of the above-described combination, but alternatively also form an (initially and temporarily) loose part after the removal of a consumed combination.

A rotationally fixed connection preferably is produced directly with the rotary handle remaining on the device housing upon the insertion of a new combination into the device housing. Alternatively, a rotary handle in the form of a loose part can be attached to a downwardly protruding end of the spindle after the insertion of the new combination. An interlock may be produced between the spindle and the rotary handle in order to secure the combination in the device housing, wherein said interlock can be disengaged by the user without tools in order to remove a consumed combination, e.g. as a result of exerting pressure upon the spindle in the direction of its longitudinal axis.

Alternatively or additionally to one or more of the above-described approaches, the objective furthermore may be attained in that the lower surface has one or more interlocking formations, which interact with one or more mating interlocking formations of the rotary handle, and in that a circumferentially extending annular region, on which the housing bottom and the rotary handle can directly abut on one another, is formed at least radially inside of an interlocking formation.

Basic rotational positions of the rotary handle relative to the device housing can be defined due to the arrangement and design of interlocking formations on the housing and mating interlocking formations on the rotary handle. In the respective basic rotational position, the interlocking formations and the mating interlocking formations are in an engaged position that can be intentionally overrun by the user. Furthermore, the same rotational angles of the rotary handle and accordingly the same linear moving distances of the support carrying the compound can thereby be achieved between two successive interlocked rotational positions in a rotating direction.

Such a design may be particularly advantageous if the device has a noncircular outline, in which the device housing and the rotary handle have identical contours. The defined interlock of the rotary handle, in which an identical contour alignment of the rotary handle and the device housing preferably is realized, can thereby be produced at this location.

An areal support of the rotary handle on the lower surface of the housing bottom may be formed at least in a region radially inside of the interlocking formation, wherein such a supporting region preferably is formed over the entire circumference concentric to the longitudinal axis.

The characteristics of the above-described independent claims respectively are important individually, as well as in any combination with one another, wherein characteristics of an independent claim furthermore can be combined with the characteristics of another independent claim or with characteristics of multiple independent claims, as well as with only individual characteristics of one or more other independent claims.

Other characteristics of the invention are frequently described below, as well as in the description of the figures, in their preferred association with the object of claim 1 and/or the other independent claim or with characteristics of other claims. However, they may also be important in association with only individual characteristics of claim 1 and/or the other independent claim or the respective other claim or independently.

According to a potential embodiment, the spindle nut may be realized in the form of an elongate sleeve that may downwardly protrude beyond the support opposite to the moving direction by a length corresponding to a multiple of the spindle outside diameter. In this case, the sleeve may be provided with an internal thread for interacting with the external thread of the spindle over its entire length. In the lower starting position of the support, the sleeve preferably can encompass the spindle over its entire length viewed in the direction of the longitudinal axis. The corresponding length of the sleeve, by which the sleeve protrudes beyond the support in a direction facing away from the compound carried by the support, may in this case correspond, for example, to 5-times to 20-times or more, furthermore to approximately 10-times, the spindle outside diameter. This characterization is also important alternatively to the characterization that the spindle nut has in the direction of the longitudinal axis a length that is equal to or greater than the distance between the lower starting position and the maximally extended upper position in the moving direction of the support.

In another embodiment, the lower starting position of the support may be defined by an abutment of the upper end of the spindle nut on the spindle. In this case, the upper end of the spindle nut, which particularly is designed in a sleeve-like manner, can cover the spindle, e.g. similar to a cap. The spindle nut accordingly may be closed on its face side. In the lower starting position of the support, this cap section on the end of the spindle nut can move against the facing spindle in a stop-limiting manner. In this respect, it would also be possible, for example, to provide a section that protrudes radially inward, e.g. in the form of a projection, on the end of the spindle nut in order to interact with the spindle end in a stop-limiting manner.

In an alternative embodiment, the lower starting position may also be defined by an abutment of the lower end of the spindle nut on the spindle, optionally on a spindle base. This may concern, in particular, the lower sleeve-like end of the spindle nut that moves against the spindle base in a stop-limiting manner. Adjacent to the thusly formed abutment region, the spindle may be respectively rooted in the spindle base or extend out of the spindle base and, for example, preferably be realized integrally with the spindle base.

The diameter of the spindle base preferably is increased in comparison with the spindle having the external thread, e.g. 2-times to 10-times, furthermore approximately 5-times.

The support, which that can be moved in a piston-like manner, may have a central region that is assigned to the spindle nut and/or the spindle. This central region of the support, in particular, may be connected to the spindle nut, particularly in a rotationally fixed manner. In another embodiment, this central region of the support optionally may be completely or partially penetrated by an upper end section of the spindle.

According to a potential embodiment, this central region of the support may be designed in a closed manner such that a surface, which preferably is completely closed in the direction of the compound and also in the opposite direction, particularly is formed in this region. This central region of the support may also be designed in a partially closed manner, e.g. by arranging webs or the like that optionally extend radially or concentric to the longitudinal axis.

According to another preferred embodiment, the surface of the support assigned to the compound may be designed in a completely closed manner. Accordingly, the compound carried by the support is in this embodiment preferably supported over its entire surface.

According to a potential embodiment, the spindle nut may with respect to the moving direction of the support or with respect to the alignment of the longitudinal axis protrude upward in the direction of the compound beyond the central region of the support. Accordingly, such an end section of the spindle nut, which optionally extends beyond the surface of the support carrying the compound, may be circumferentially encompassed or covered by the compound, preferably also in a cap-like manner. The compound, e.g. in the form of a refill pack, accordingly may have a preferably central depression on the side facing the compound supporting surface in order to accommodate this end of the spindle nut.

In a preferred embodiment, the end section of the spindle nut optionally extends beyond the surface of the support carrying the compound by a certain dimension viewed in the direction of the longitudinal axis, wherein said dimension may correspond to approximately 0.1-times to 2-times, furthermore to approximately 0.8-times to 1.5-times, the spindle outside diameter.

A refill pack may solely consist of the compound, which has a corresponding shape for being accommodated in the device housing and for being supported on the support. For example, this refill compound may initially be packaged in a plastic film and optionally furthermore packaged in a cardboard box or the like.

In a refill pack consisting of a combination of the support, the spindle and the compound, a potential embodiment proposes that the spindle and the support preferably are accommodated in an inner housing that is realized separately of the device housing. In this case, the inner housing preferably forms part of the refill pack such that the compound is always surrounded by a wall, particularly a plastic wall, in the course of loading the device housing with a new refill pack. Furthermore, the inner wall may in this case preferably also define the shape of the compound to be accommodated, particularly along the circumference.

The compound accommodated in the combination within the inner housing is circumferentially guided by the inner housing, which is stationary relative to the compound and the support, in the course of the movement of the compound in the direction of the longitudinal axis of the spindle.

The rotary handle may have an outer coupling part and the spindle may have an inner coupling part in order to connect the rotary handle to the spindle, particularly in a rotationally fixed manner. A reversed design, in which the rotary handle has an inner coupling part and the spindle has an outer coupling part, would also be conceivable in this respect.

According to a potential embodiment, the coupling parts respectively may be designed concentric to the longitudinal axis of the spindle, e.g. in order to form a circumferential pot-like walls, wherein the inner wall surface of one part moves into a rotationally fixed form-fit position with the outer surface of the other wall. For example, a toothing of the coupling parts that acts in the circumferential direction furthermore may be realized in this respect.

In another embodiment, a circumferentially extending annular region, on which the housing bottom and the rotary handle can directly abut on one another, may be formed radially outside of an interlocking formation as an alternative or preferably in addition to a radially inner support. Accordingly, a comparatively large-surface support can thereby be achieved.

For example, an interlocking formation and a mating interlocking formation respectively may have a circular outline, wherein one formation is realized in the form of a bowl-like depression, into which the other formation in the form of an adapted elevation can engage.

In a preferred embodiment, two interlocking formations are provided on the lower surface of the housing bottom and two mating interlocking formations are provided on the handle such that two defined basic rotational positions can be realized in the rotating direction of the rotary handle.

In this case, the interlocking formations and the mating interlocking formations respectively may be arranged diametrically opposite of one another with respect to the longitudinal axis.

With respect to the disclosure, the ranges or value ranges or multiple ranges indicated above and below also include all intermediate values, particularly in 1/10 increments of the respective dimension, but optionally also dimensionless. For example, the indication 0.5-times to 2.5-times also includes the disclosure of 0.6-times to 2.5-times, 0.5-times to 2.4-times, 0.6-times to 2.4-times, etc. The respective disclosure may on the one hand serve for defining a lower and/or upper limit of a cited range, but alternatively or additionally also for disclosing one or more singular values from a respectively indicated range.

BRIEF DESCRIPTION OF THE DRAWINGS

The invention is described in greater detail below with reference to the attached drawings that, however, merely show exemplary embodiments. A component, which is described with reference to one of the exemplary embodiments and not replaced with a different component in another exemplary embodiment, is therefore also described as a potentially existing component in this other exemplary embodiment. In the respective drawings.

DESCRIPTION OF THE EMBODIMENTS

Figure 1:
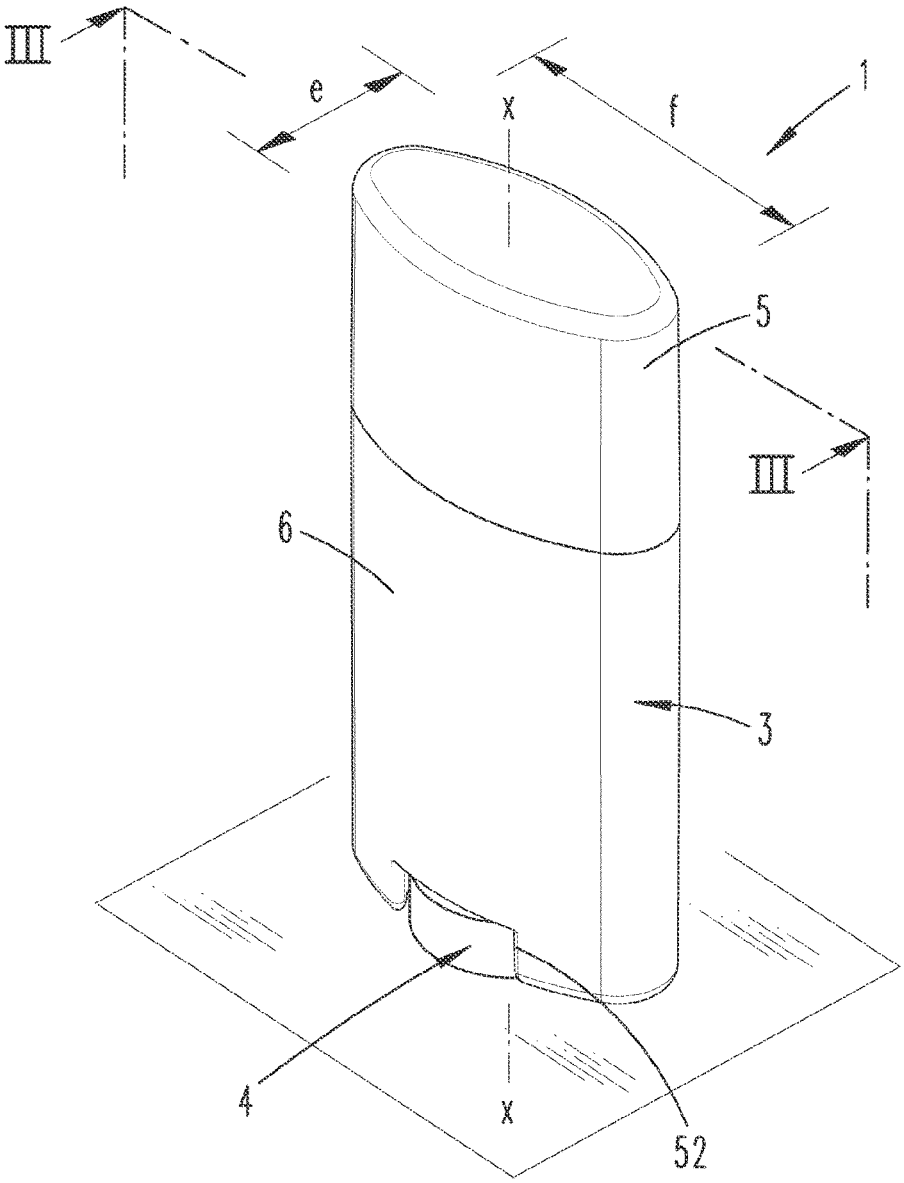
FIG. 1 shows a device of the type in question in the form of a perspective view concerning a first embodiment.
Figure 2:
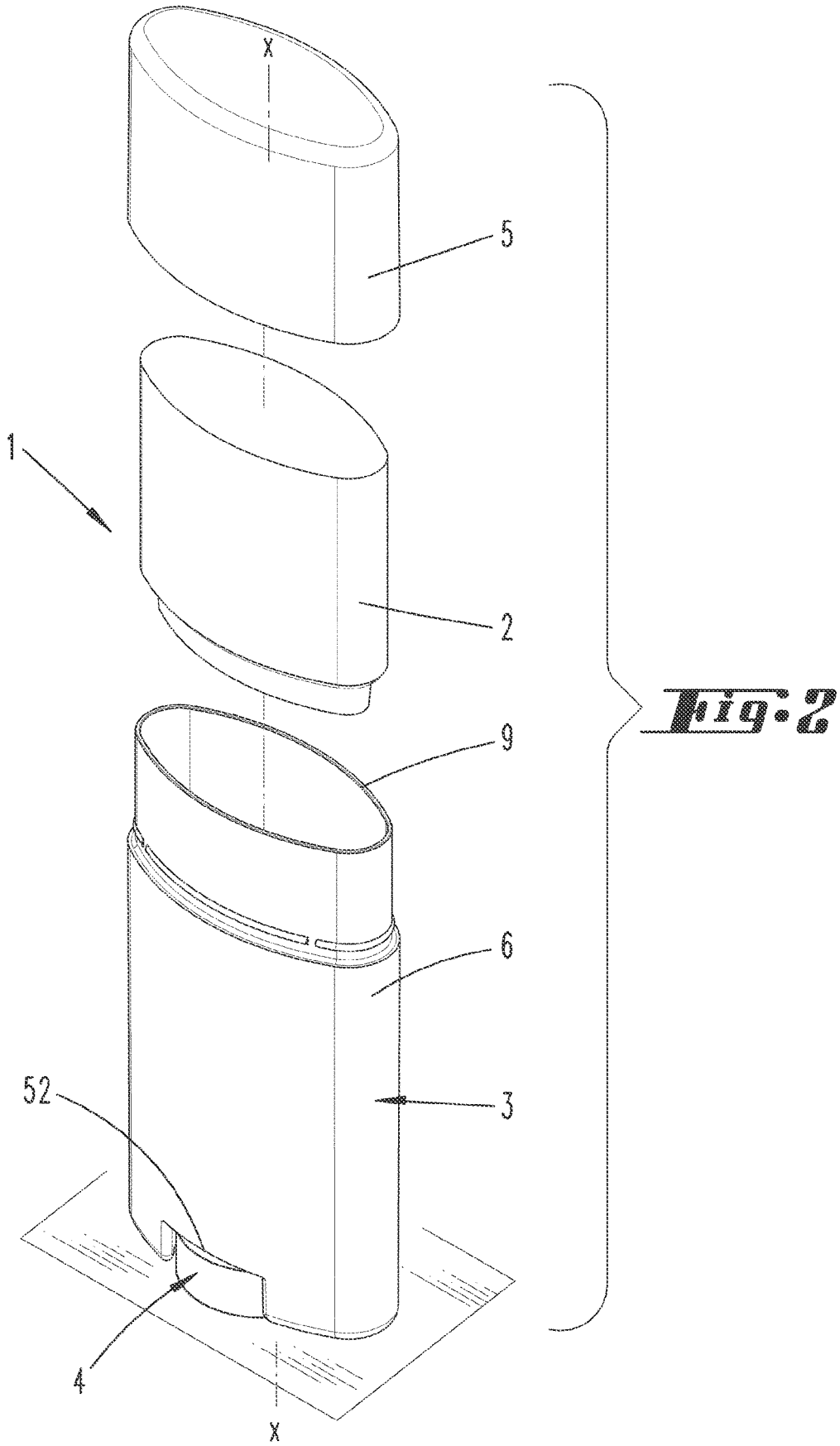
FIG. 2 shows the device in the form of an exploded perspective view.

A device 1 for dispensing a compound 2, e.g. in the form of a deodorant stick, initially is described with reference to FIGS. 1 to 3.

The device 1 furthermore is designed for being refilled with compound 2. The device as a whole therefore is a refillable device, in which particularly a device housing 3, a rotary handle 4 and preferably also a covering cap 5 can be reused.

Figure 7:
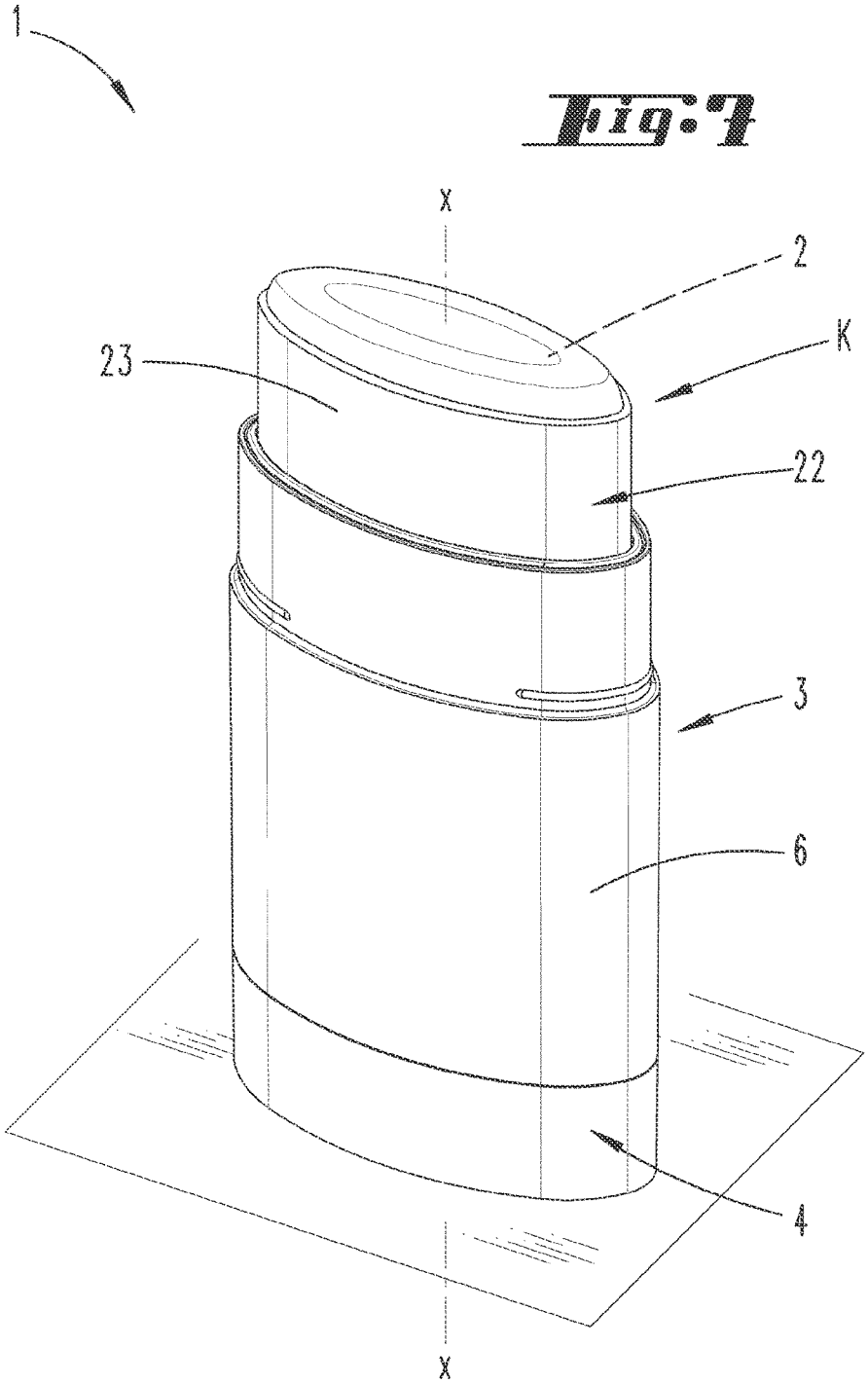
FIG. 7 shows the device according to FIG. 6 concerning an upper extended position of a compound stored in the device.
Figure 8:
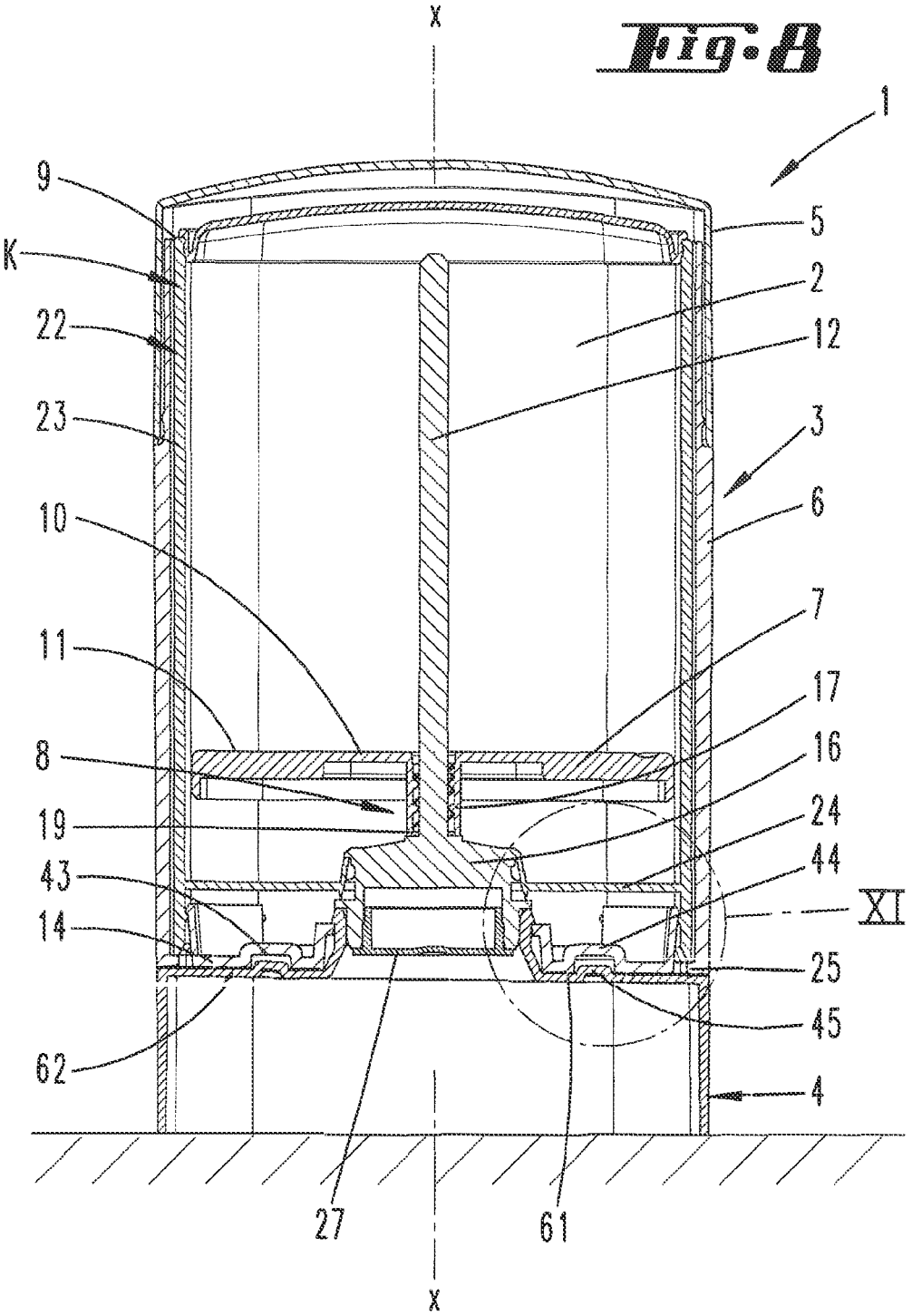
FIG. 8 shows the device according to FIG. 6 in the form of a longitudinal section.

The compound, which preferably is altogether solid and stable, is seated in the device housing 3 on a movable support 7 and directly or indirectly surrounded by the wall 6 of the device housing 3. This support 7 can be moved by means of a moving arrangement 8 between a lowermost starting position, which is illustrated, for example, in FIG. 3 and also in FIGS. 4 and 5, and a maximally extended uppermost position along a longitudinal axis x that at the same time preferably forms a central longitudinal body axis of the device 1. The uppermost extended position is indicated with dot-dash lines in the illustration according to FIG. 3 (first embodiment of the device 1). This extended position furthermore is shown, for example, in FIG. 7 with reference to a fourth embodiment.

The device housing 3 as a whole essentially defines the shape of the device 1, wherein the device 1 and particularly the device housing 3 according to FIGS. 1 to 11 and 16 to 26 may with respect to an outline, in which the longitudinal axis x is illustrated in the form of a point, have an oval outer contour with a longitudinally extending direction and a narrow extending direction viewed transverse thereto. Alternatively, a circular outline with respect to the longitudinal axis x may be chosen in accordance with the embodiment in FIGS. 12 to 15.

In the covering position, the covering cap 5 covers a housing opening 9, through the center of which the longitudinal axis x extends and through which the compound 2 can be moved into a usable protruding position by means of the moving arrangement 8 after the removal of the covering cap 5.

The contour of the support 7 preferably is circumferentially adapted to the extent of the inner side of the directly facing circumferential wall. The support 7, which can be moved along the longitudinal axis x in a moving direction r in a piston-like manner, particularly may have a closed central region 10. Furthermore, the surface 11 facing the compound 2, on which the compound 2 is supported in the device 1, may be designed in a completely closed manner.

In an alternative embodiment, a support 7 that is at least partially open, optionally with the exception of the central region 10, may also be provided, wherein the device 1 can be initially filled with compound 2 through this support. For example, such an initial filling process may take place in an overhead position of the device 1 provided with a covering cap 5.

The moving arrangement 8 particularly has a spindle 12 with a spindle axis, which in the usage position of the device 1 coincides with the longitudinal axis x. The spindle 12 is connected to the rotary handle 4 in a rotationally fixed manner in the usage position of the device 1.

If the device 1 has the preferred oval outline, the rotary handle 4 according to the embodiments illustrated in FIGS. 1 to 5 and 22 to 26 may have a circular outline with a diameter d that is chosen greater, e.g. 1.1-times to 1.3-times greater, than the extending dimension e of the device housing 3 in the narrow extending direction such that the rotary handle 4 accordingly protrudes on both sides in the region of the longitudinal edges of the device housing 3 in the form of a segment of a circle. To this end, the device housing 3 has opposite recesses 52, through which the rotary handle 4 partially protrudes. In this case, the diameter d of the rotary handle 4 furthermore may correspond to approximately 0.5-times to 0.75-times the extending dimension f of the device housing 3 or the device 1 as a whole in the longitudinal extending direction.

Figure 3:
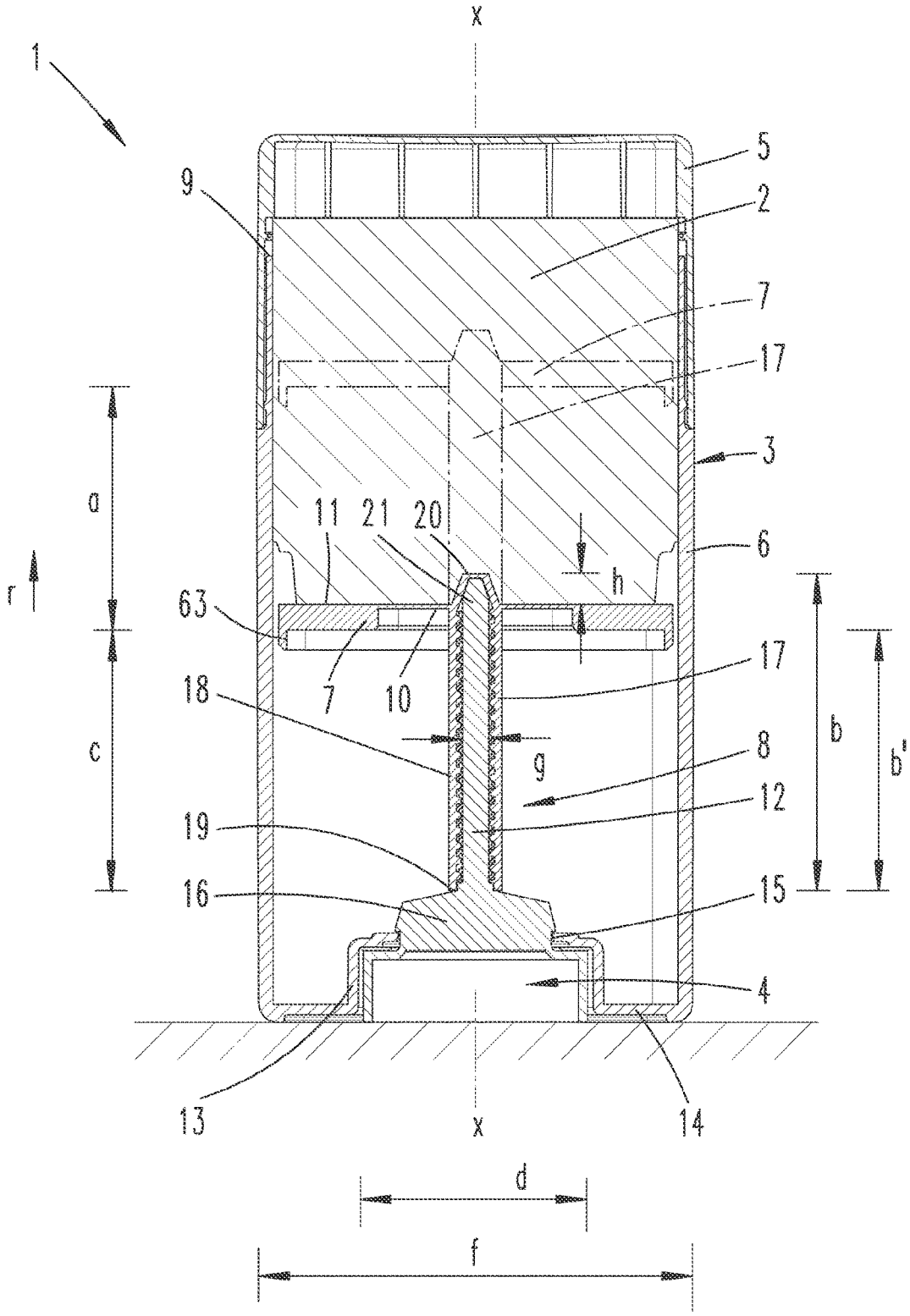
FIG. 3 shows the device according to FIG. 1 in the form of a longitudinal section.
Figure 4:
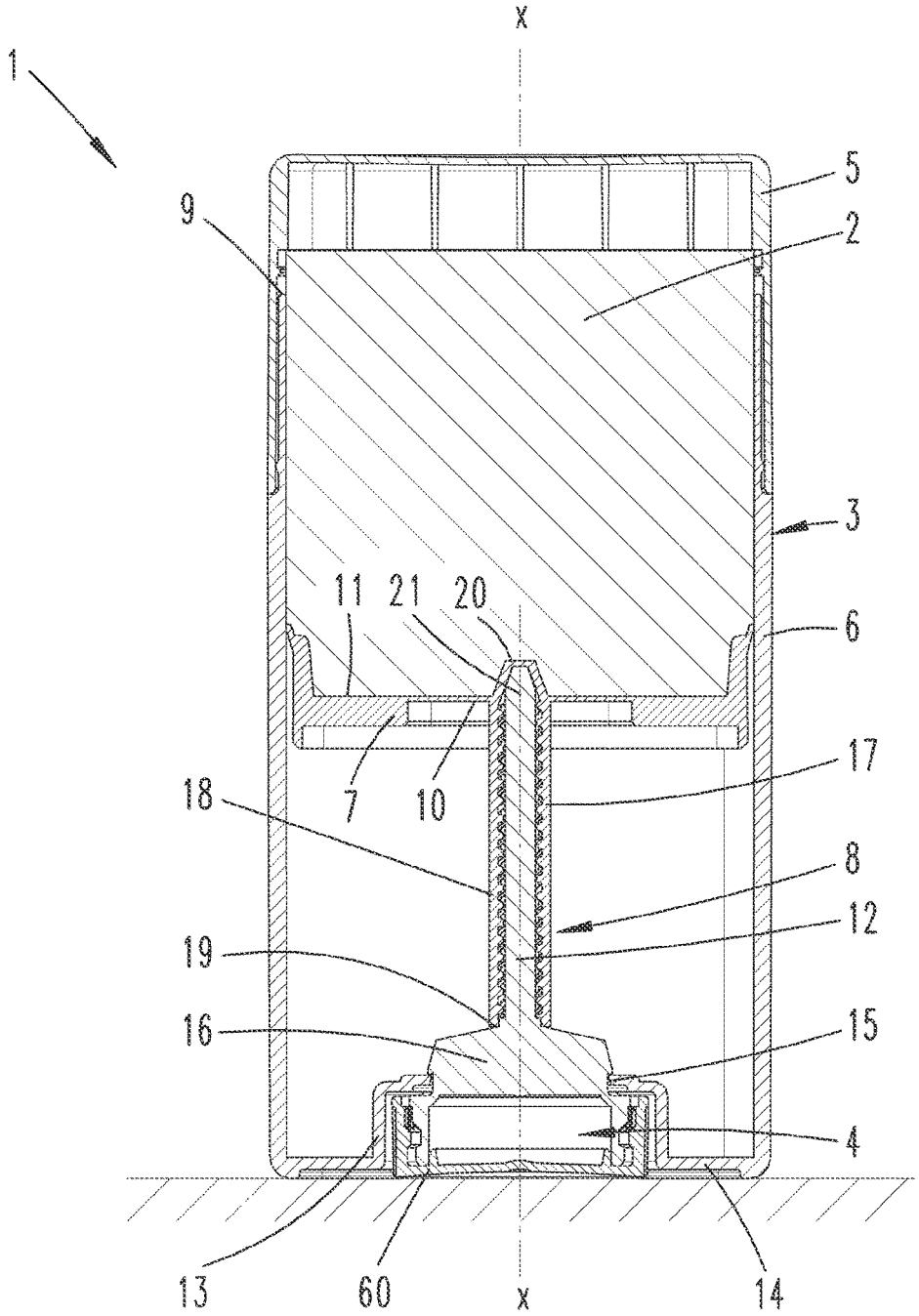
FIG. 4 shows a section corresponding to FIG. 3, but concerning a second embodiment of the device.
Figure 5:
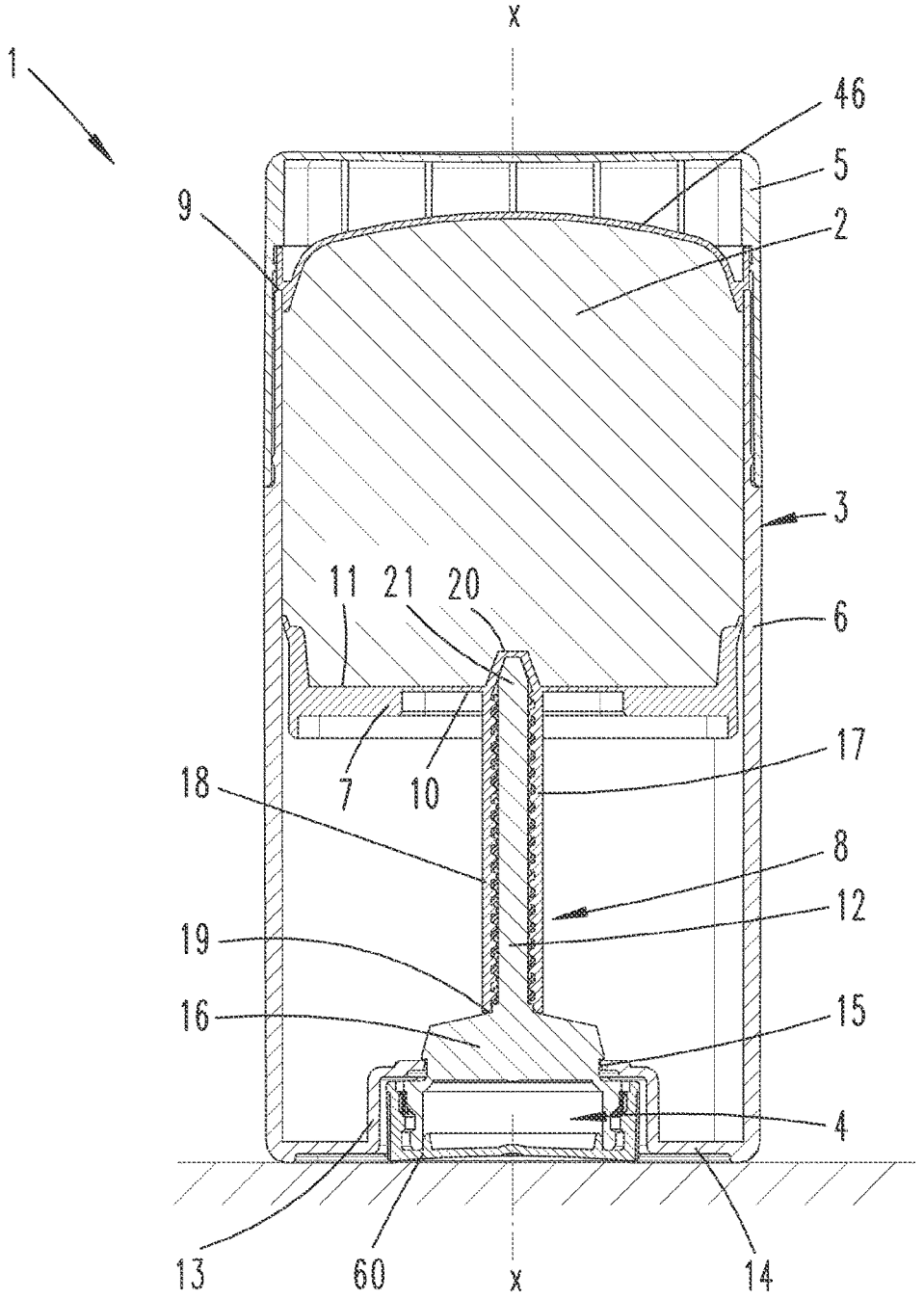
FIG. 5 shows another section corresponding to FIG. 3, but concerning a third embodiment.
Figure 6:
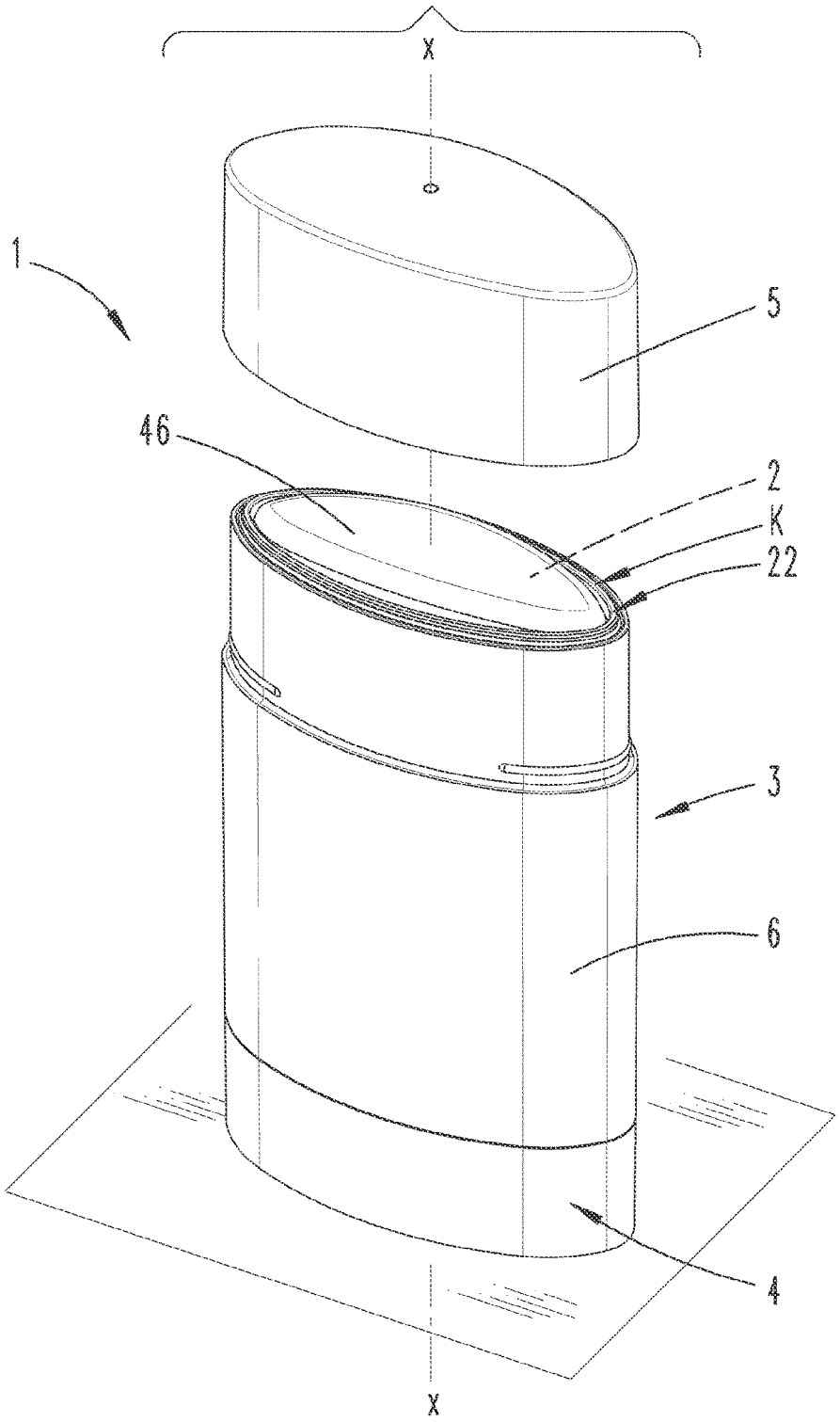
FIG. 6 shows a perspective view of a device according to a fourth embodiment.

It is furthermore preferred that the rotary handle 4, which preferably is dimensioned as described above, can be accommodated in an approximately pot-shaped receptacle 13 of the device housing 3 concentric to the longitudinal axis x, wherein said receptacle 13 is provided in the region of the housing bottom 14 facing away from the housing opening 9 (compare, for example, to the illustrations in FIGS. 3 to 5, as well as 25 and 26).

According to embodiments 1 to 3 illustrated in FIGS. 1 to 5, the rotary handle 4 may have a central thickening for forming a spindle base 16, wherein said thickening is directed into the housing interior and penetrates the receptacle 13 in the region of a central through-hole 15. In the cited exemplary embodiments, it is also preferred to realize this spindle base 16 integrally and uniformly in material with the rotary handle 4 and, in particular, integrally and uniformly in material with the spindle 12 formed directly on the spindle base 16. Furthermore, the spindle base 16 may have a diameter that corresponds to approximately 3-times to 6-times, e.g. to 5-times, a spindle diameter g and/or to approximately 0.5-times to 0.9-times, e.g. to approximately 0.7-times, the rotary handle diameter d.

In addition to the spindle 12, the moving arrangement 8 furthermore comprises a spindle nut 17, an internal thread of which interacts with the external thread of the spindle 12.

The spindle nut 17 is connected to the support 7 in a rotationally fixed manner and furthermore preferably realized integrally and uniformly in material with this support.

The rotational movement of the spindle 12 realized by means of the externally accessible rotary handle 4 causes a movement of the support 7 with the compound 2 in the moving direction r in interaction with the spindle nut 17 and, with respect to the longitudinal axis x, a circumferentially acting non-rotatability of the support 7 in the directly assigned housing. The non-rotatability already can be achieved by simply designing the housing and the support 7 with a noncircular outline, e.g. an oval outline. If the device 1 and therefore preferably also the support 7 and the housing wall directly surrounding this support 7 are designed with a circular outline, the non-rotatability can be achieved, for example, due to the interaction of a web that is aligned in the moving direction r on the inner wall side and a correspondingly positioned guide recess on the support 7 or vice versa.

The spindle nut 17 of the embodiments illustrated in FIGS. 1 to 5 is realized in the form of an axially elongate sleeve 18, which viewed in the direction of the longitudinal axis x has a length b that is chosen greater, preferably greater by approximately the factor of 1.1 to 1.3, than the resulting distance a of the support 7 between its starting position illustrated in FIGS. 3 to 5 and its maximally extended upper position indicated with dot-dash lines in FIG. 3 in the moving direction r. A spindle engagement into the spindle nut 17 can also be ensured in the maximally extended upper position of the support 7 as a result of this preferred length ratio. In this context, it is furthermore preferred that the spindle 12, as well as the section of the spindle nut 17 or the sleeve 18 interacting with the spindle 12, only extends underneath the support 7, particularly underneath the surface 11 carrying the compound 2. Accordingly, the spindle 12 advantageously does not penetrate into the region of the compound 2. The length b may also be (merely) chosen in such a way that it only comprises a length section of the spindle that is provided with a thread. In the exemplary embodiment shown, the length b' ends in this view approximately at the location, at which the length c ends (on top).

The position illustrated, for example, in FIG. 3 preferably is stop-limited. For example, a lower end 19 of the spindle nut 17 or the sleeve 18 may to this end abut on the spindle 12 or the spindle base 16 in this lower starting position. Alternatively, this stop limitation may also be realized due to the abutment of an upper end 20 of the spindle nut 17 or the sleeve 18 on the facing spindle end 21 of the spindle 12 (compare to FIG. 4). To this end, the spindle nut 17 or the sleeve 18 may be designed, for example, in a closed, cap-like manner in the region of its upper end 20. A closed, cap-like design of the sleeve 18 may also be advantageous independently of a stop function, e.g. with respect to designing the support 7 as a whole is tight as possible.

In another embodiment, the sleeve 18 can protrude beyond the support 7 downward in the direction of the housing bottom 14 and opposite to the moving direction r by a length c, wherein said length c may correspond to approximately one-fifth to one-tenth, furthermore to approximately one-eighth, of the spindle outside diameter g. In this case, the length c is plotted continuously, optionally with the exception of an inner drawn-in section in the region of the spindle nut 17 of the support 7, starting from a cross-sectionally continuous lower edge of the support 7, but in any case independently of an optionally circumferential lip 63 of the support, which slightly protrudes further downward on the edge and preferably is provided additionally.

The spindle nut 17 or the sleeve 18 preferably is connected to the support 7 in the central region 10, wherein the spindle nut 17 or the sleeve 18 may according to a potential embodiment upwardly protrude beyond the central region 10 and beyond the surface 11 in the moving direction r of the support 7 with its upper end 20. A resulting height h of the spindle nut 17 above the support 7, which is plotted over the surface 11 in the direction of the longitudinal axis x, may correspond to approximately 0.8-times to 2-times, furthermore to approximately 1-time to 1.2-times, the spindle outside diameter g.

After the compound 2 has been consumed, a potentially existing remnant of the compound 2 can be very easily removed through the housing opening 9 and replaced through the housing opening 9 from above.

After the optionally original compound has been consumed, in which case the support preferably is in the maximally extended upper position, this can according to the proposed method be achieved by initially spindling down the support and then merely inserting compound from above. The compound may have a removable cover, e.g. of paper, by means of which it can then be pressed down by hand. The compound can be pressed down until the support prevents further movement. The cover can then be removed.

The illustrations in FIGS. 6 to 26 show various other embodiments, in which a combination K is provided for replacing consumed compound 2, wherein said combination initially and essentially consists of the support 7 and the compound 2 arranged thereon, as well as the spindle 12. The combination K may also be referred to as replacement or refill cartridge. In this case, it is also preferred that the spindle nut 17 is integrally formed on the support 7 in a direct and rotationally fixed manner, wherein the spindle 12 extends through the support 7 and its surface 11 in its longitudinal extending direction and penetrates into the region of the compound 2. In the resulting lower starting position of the support 7, e.g. according to the illustrations in FIGS. 8, 12, 19 and 22, the support 7 is arranged at a slight distance from the spindle base 16 in the axial direction. A stop-limited lower starting position can also be realized in this case, e.g. due to the abutment of the lower end 19 of the spindle nut 17 on the spindle base 16.

The embodiments in FIGS. 16 to 26 show a combination K that only comprises the spindle 12, the support 7 and the compound 2. The support 7, as well as the compound 2 carried by this support 7, is directly surrounded by the wall 6 of the device housing 3 in the usage position.

An alternative combination K is illustrated in the embodiments in FIGS. 6 to 15, in which the combination K additionally comprises an inner housing 22. In this case, the wall 23 of the inner housing 22 directly surrounds the support 7 with the compound 2 carried thereon, wherein it is furthermore preferred that the contour of the inner housing is with respect to the wall 23 adapted to the inner contour of the wall 6 of the device housing 3. Furthermore, the inner housing 22 preferably can be provided with an inner housing bottom 24, which particularly and essentially is penetrated by the spindle base 16.

If the recombination K comprises an inner housing 22, in particular, the combination K inserted into the device housing 3 from above may encounter a stop limitation in the inserted position. For example, the inner housing 22 respectively may abut on a section of the housing bottom 14 of the device housing 3 or on a stop shoulder 25 formed in the bottom region of the device housing 3 in a stop-limiting manner (compare particularly to FIGS. 11 and 15).

In the embodiments illustrated in FIGS. 6 to 15, in which the combination K comprises an inner housing 22, the spindle 12 is in the inserted position guided so as to be rotatable about the longitudinal axis x by means of its spindle base 16 in the region of a central through-hole 26 in the inner housing bottom 24, optionally and preferably while forming a defined interlock in the direction of the longitudinal axis x. In this case, the spindle base 16 may starting from the through-hole 26 extend upward in the direction of the support 7, as well as downward beyond the inner housing bottom 24, in the extending direction of the longitudinal axis x as shown, wherein the spindle base 16 furthermore may have a downwardly directed circular pot shape, particularly underneath the inner housing bottom 24.

The through-hole 26 furthermore may be formed in the region of a collar 28 that conically extends over the circumference with respect to the longitudinal axis x and essentially is directed toward the support 7, wherein said collar may optionally act upon the circumferential wall of the spindle base 16 in a sealing manner.

In a preferred embodiment, the wall 23 of the inner housing 22 preferably is designed so as to extend downward beyond the inner housing bottom 24 such that the above-described pot-shaped section of the spindle base 16 preferably is accommodated within the space 29 enclosed by the wall 23 underneath the inner housing bottom 24. The downwardly directed circumferential face edge of the inner housing wall 23 may define a positioning plane, which is aligned transverse to the longitudinal axis x and serves for positioning the combination K on a preferably planar surface.

The downwardly pot-shaped design of the spindle base 16 may be covered with a plug 27 that can be engaged with the spindle base 16 or with a snap-on cap 60 (compare, for example, to FIGS. 3 and 4).

A retaining pedestal 30, which with respect to the longitudinal axis x extends at least partially in the circumferential direction, preferably can be arranged in the above-described space 29 underneath the inner housing bottom 24. This retaining pedestal preferably is connected, in particular permanently connected, to the device housing 3, e.g. as a result of an integral design. To this end, the retaining pedestal 30 may be circumferentially fastened, e.g. sectionally, on the inner side of the wall 6 of the device housing 3. In the sections of the retaining pedestal resulting between the fastening regions in the circumferential direction, this retaining pedestal extends at a radial distance from the wall 6 of the device housing 3, particularly in the form of an interlocking web 31 that approximately extends in the direction of the longitudinal axis x, in order to form a passage for the foot section of the inner housing wall 23, which in the inserted position of the combination K furthermore extends underneath the inner housing bottom 24.

The interlocking web 31 of the retaining pedestal of the device preferably has an outwardly directed interlocking tab 32 for interacting with an inwardly directed mating interlock 33 on the inner housing wall 23 in an interlocking manner in the stop-limited inserted position of the combination K into the device housing 3. In this way, the combination K is retained in the device housing 3 by means of the inner housing 22 in an interlocking manner.

It is furthermore preferred that the retaining pedestal 30 is provided with a central opening 34 that preferably is formed concentric to the longitudinal axis. This opening preferably is penetrated by a retaining wall 35 of the rotary handle 4 arranged underneath the housing bottom 14 from below in the direction of the receptacle space for accommodating the combination K, wherein said retaining wall preferably extends circumferentially concentric to the longitudinal axis x. An interlocking projection 36, which protrudes radially outward, engages behind the circumferential edge of the opening 34 in order to fix the rotary handle 4 on the device housing 3 in an interlocking manner while allowing a rotation of the rotary handle 4 relative to the device housing 3 about the longitudinal axis x. According to a potential embodiment, the rotary handle 4 can thereby also be retained on the device housing 3 in a captive manner in the course of an exchange of the combination K.

In another embodiment, the spindle base 16 can in the inserted position of the combination K be supported on an upwardly directed edge surface of the retaining wall 35 by means of a radially directed shoulder 37.

In the properly inserted position of the combination K into the device housing 3, the spindle 12 or its spindle base 16 and the rotary handle 4 are coupled to one another in order to connect the spindle 12 and the rotary handle 4 in a rotationally fixed manner in the circumferential direction.

To this end, the rotary handle 4 may form an outer coupling part 38 that is directed radially inward, particularly in the region of its retaining wall 35, wherein said outer coupling part interacts with an inner coupling part 39 of the spindle 12. In this case, the inner coupling part 39 preferably is formed on the outer side of the circumferential pot-shaped wall of the spindle base 16 extending underneath the inner housing bottom 24 and accordingly is directed radially outward.

Figure 20:
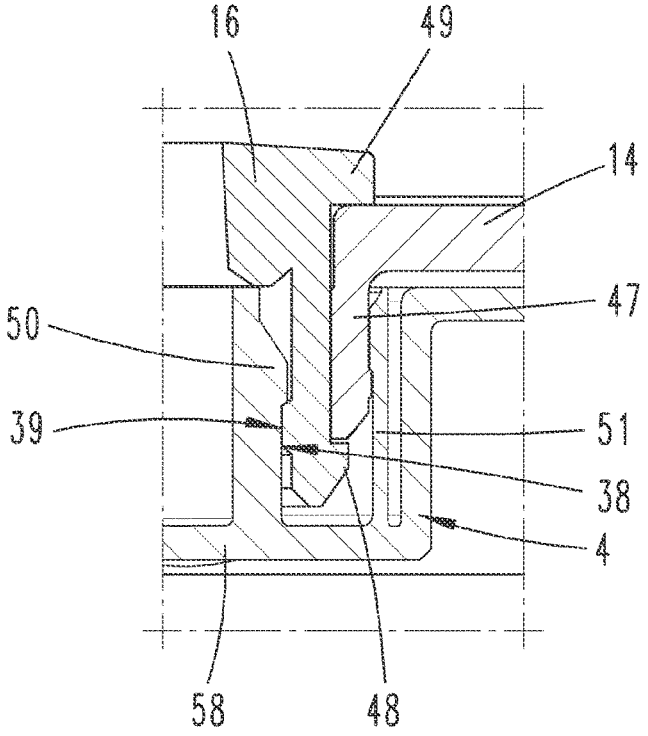
FIG. 20 shows an enlarged detail of the region XX in FIG. 19.
Figure 21:
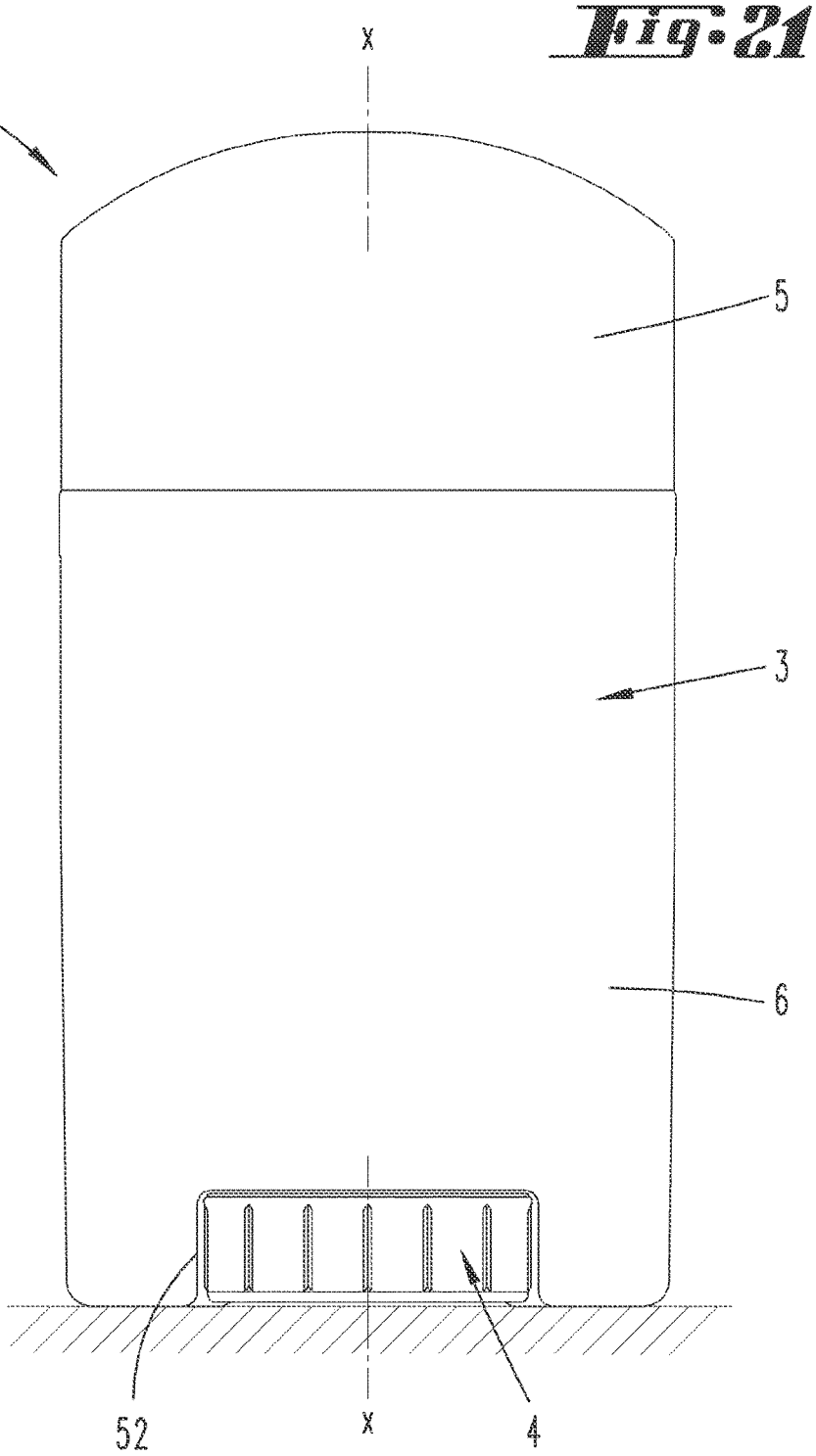
FIG. 21 shows the device in the form of a side view concerning another embodiment.
Figure 22:
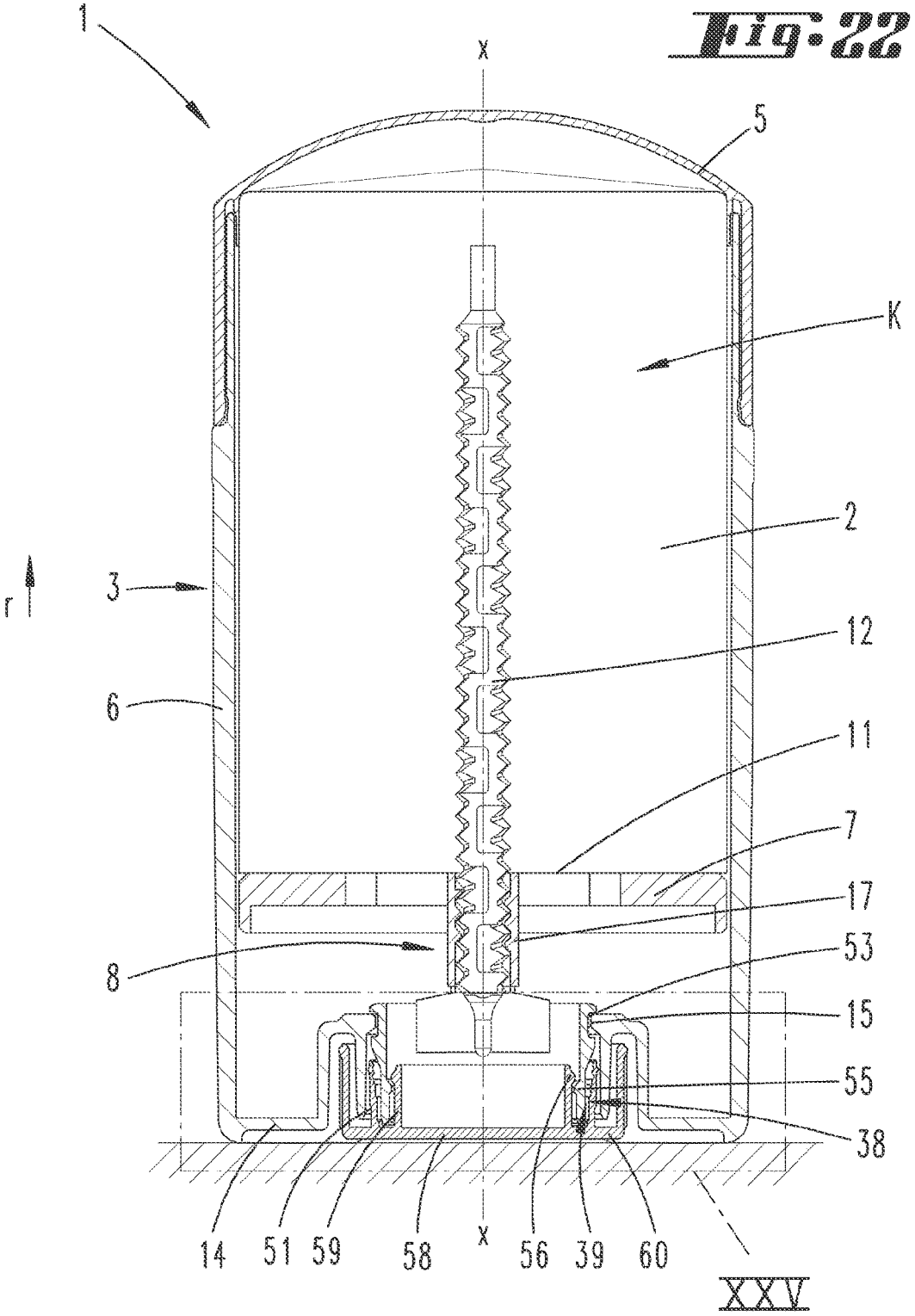
FIG. 22 shows the device according to FIG. 21 in the form of a longitudinal section.
Figure 23:
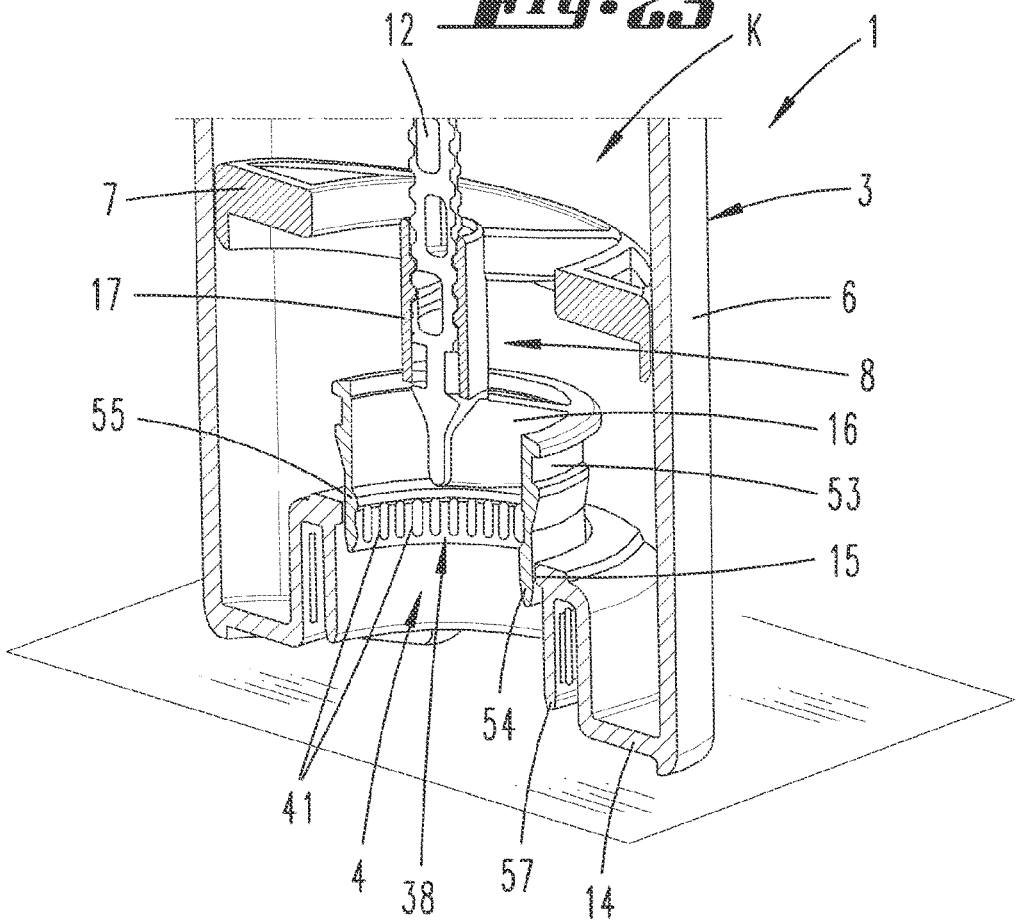
FIG. 23 shows a lower region of the device in the form of a sectioned perspective view concerning an intermediate position in the course of the installation of a combination into the device housing.
Figure 24:
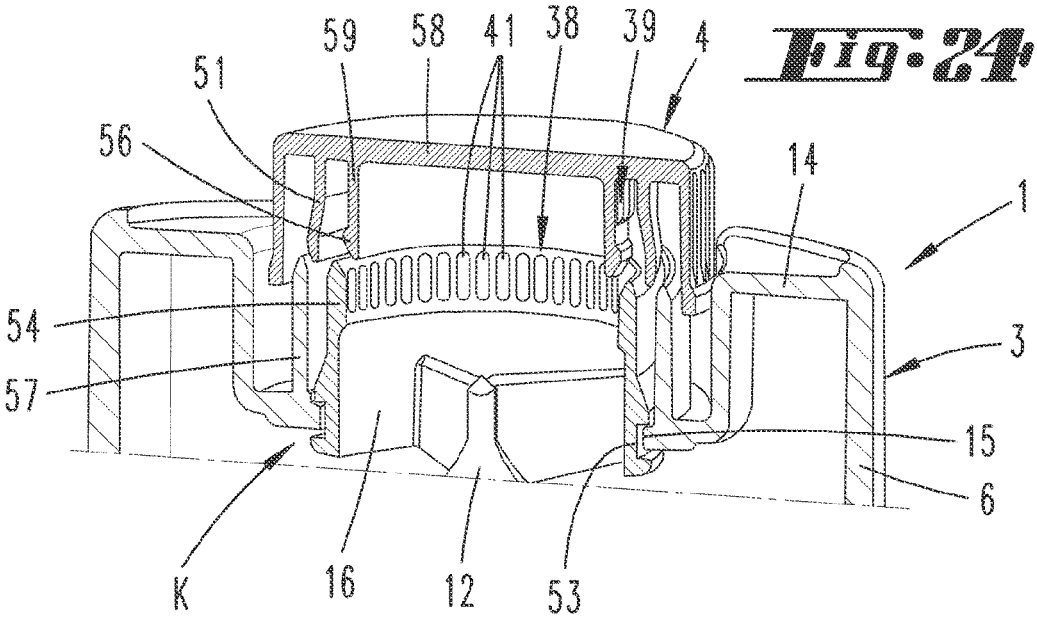
FIG. 24 shows the lower region according to FIG. 23 in an overhead position in the course of the installation of a rotary handle.
Figure 25:
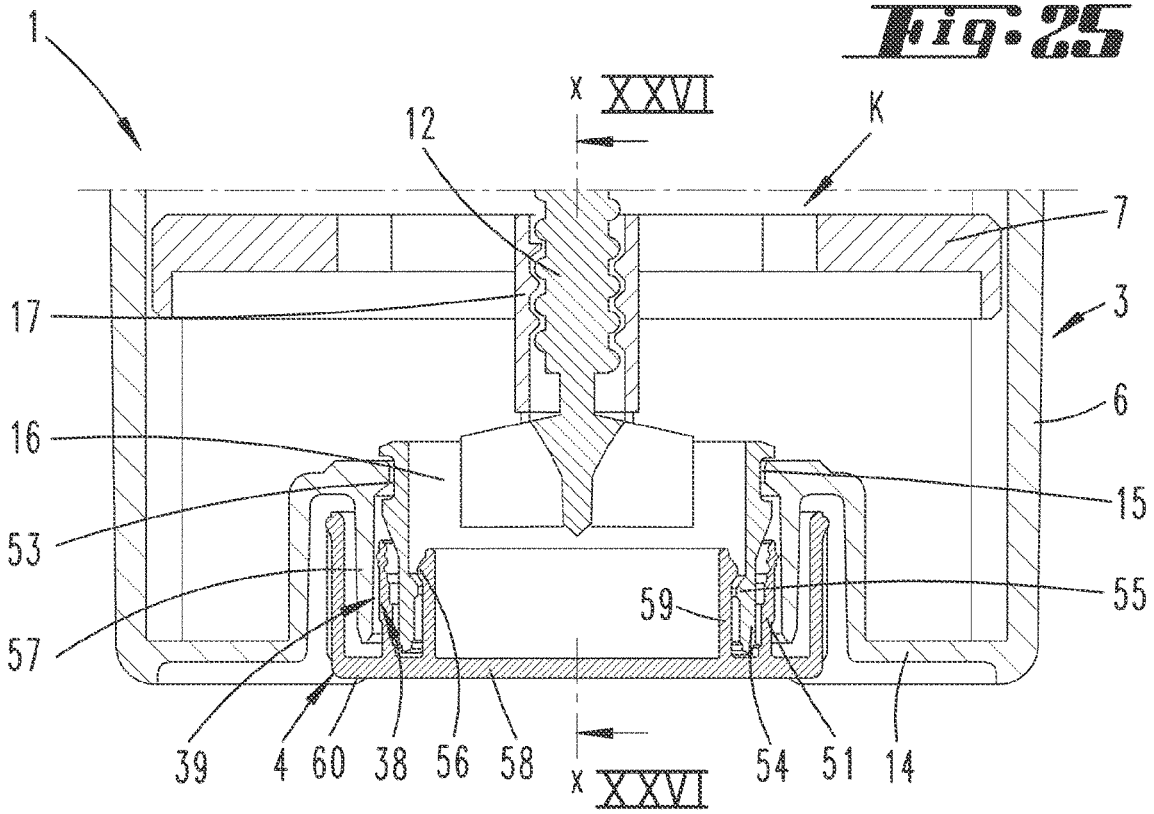
FIG. 25 shows an enlarged detail of the region XXV in FIG. 22.
Figure 26:
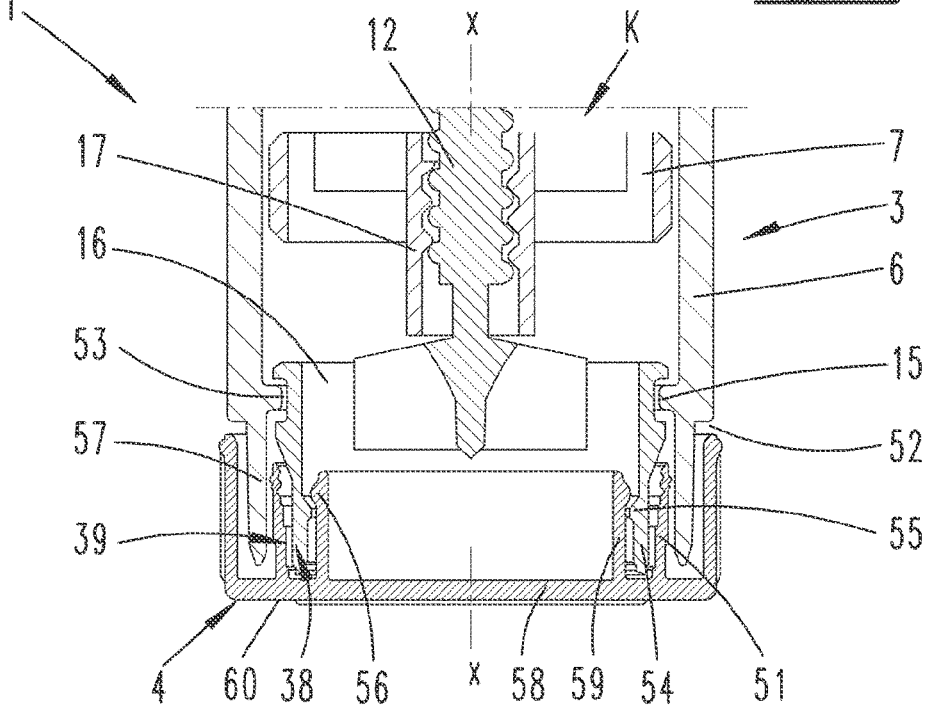
FIG. 26 shows a section along the line XXVI-XXVI in FIG. 25.

The enlarged illustrations in FIGS. 20 and 25 or 26, in particular, furthermore show that the inner coupling part 39 may according to the embodiments illustrated in these figures alternatively be formed on the rotary handle 4 and the outer coupling part 38 may be formed on the spindle 12 or the spindle base 16, respectively.

It is preferred that the outer coupling part 38 and the inner coupling part 39 only interact in a form-fitting manner in the circumferential direction. For example, one of the two coupling parts may to this end have radially protruding ribs 40, which are uniformly distributed over the circumference and essentially aligned in the direction of the longitudinal axis x, wherein said ribs can engage into correspondingly positioned slot-shaped receptacles 41 of the other coupling part in a form-fitting manner.

A rotation of the rotary handle 4 about the longitudinal axis x therefore is transmitted to the spindle 12 in a form-fitting manner. This in turn leads to a linear movement of the support 7 with the compound 2 in the moving direction r.

The illustrations in FIGS. 6 to 15 furthermore show that the outline of the rotary handle 4 may according to the embodiments illustrated in these figures have a contour that essentially corresponds to the device housing 3. The outline of the rotary handle 4 has an essentially oval contour in the embodiment according to FIGS. 6 to 11 whereas an exemplary circular rotary handle 4 is provided in the embodiment according to FIGS. 12 to 15.

In a noncircular outline of the device 1 and a corresponding noncircular outline of the rotary handle 4, it may be preferable to realize basic rotational positions of the rotary handle 4, in which the rotary handle 4 essentially overlaps with the assigned device housing 3 in the direction of the longitudinal axis x. Two basic rotational positions of the rotary handle 4 can be realized in an oval outline as shown. It is furthermore preferred that these two basic rotational positions are defined by an interlock that can be overrun. To this end, a lower surface 43 of the retaining pedestal 30, which retaining pedestal essentially forms the housing bottom 14 and which lower surface faces a ceiling 42 of the rotary handle 4, may sectionally have an interlocking formation 44 in the form of a cup-like depression, into which a preferably shape-adapted mating interlocking formation 45 in the form of an elevation in the region of the rotary handle ceiling 42 engages in one of the basic rotational positions of the rotary handle 4.

In the exemplary embodiment shown, regions 63 and 64, which with respect to the longitudinal axis x extend circumferentially in an annular manner, respectively are formed radially inside and radially outside of the interlocking formations 44 and the mating interlocking formations 45, wherein the housing bottom 14 or the lower surface 43 of the retaining pedestal 30 respectively can directly abut on the rotary handle 4 or its ceiling 42 in a supporting manner in said regions 63 and/or 64.

Figure 9:
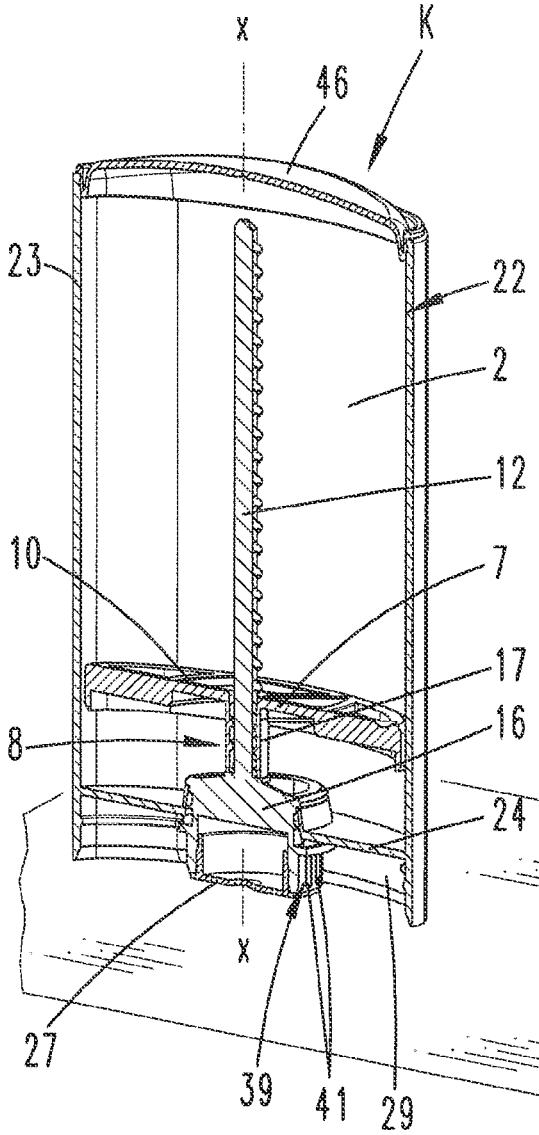
FIG. 9 shows a sectioned perspective view of a combination consisting of a support, a spindle and the compound, as well as an inner housing, for being inserted into a device housing of the device according to FIG. 6.
Figure 10:
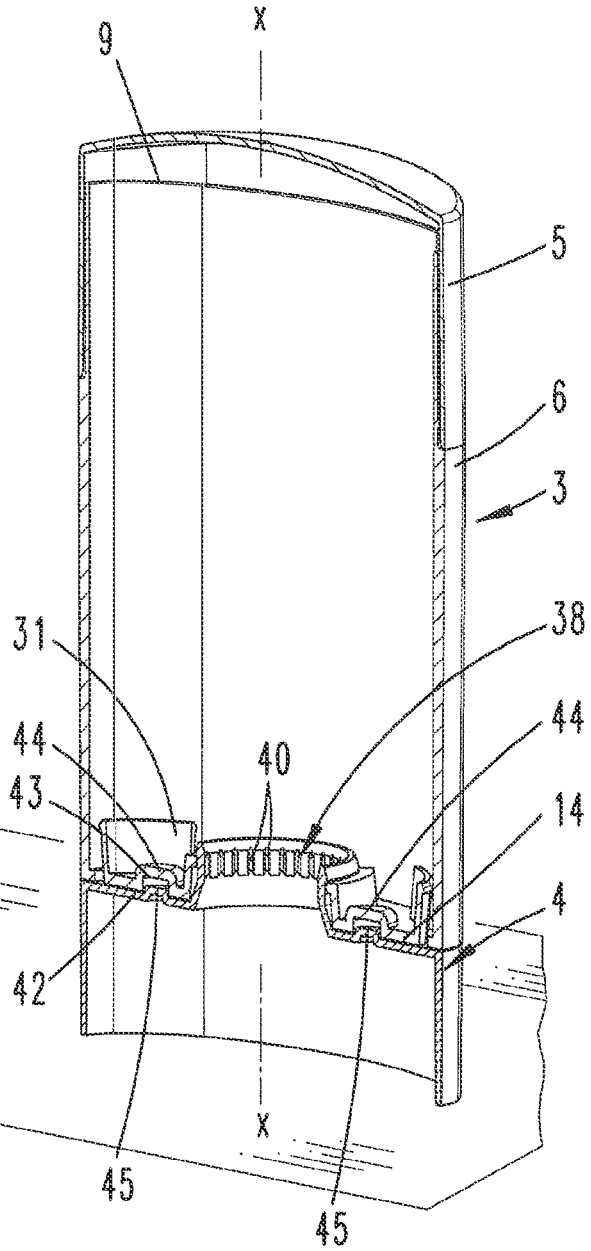
FIG. 10 shows a sectioned perspective view of the device housing of the device according to FIG. 6.
Figure 11:
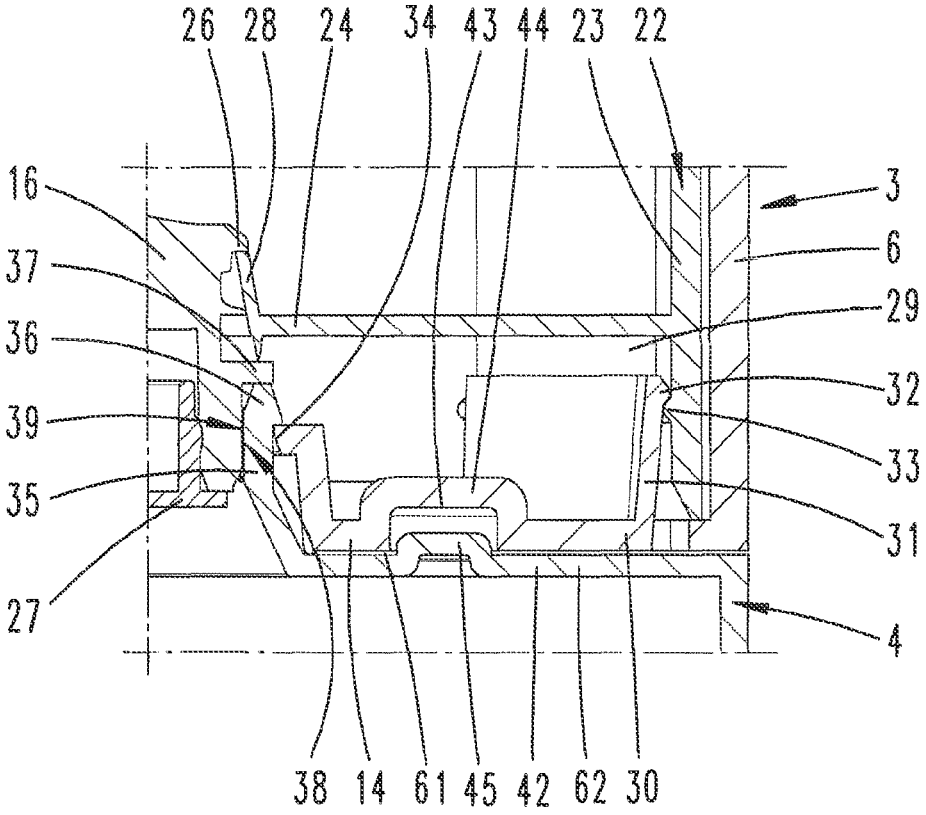
FIG. 11 shows an enlarged detail of the region XI in FIG. 8.
Figure 12:
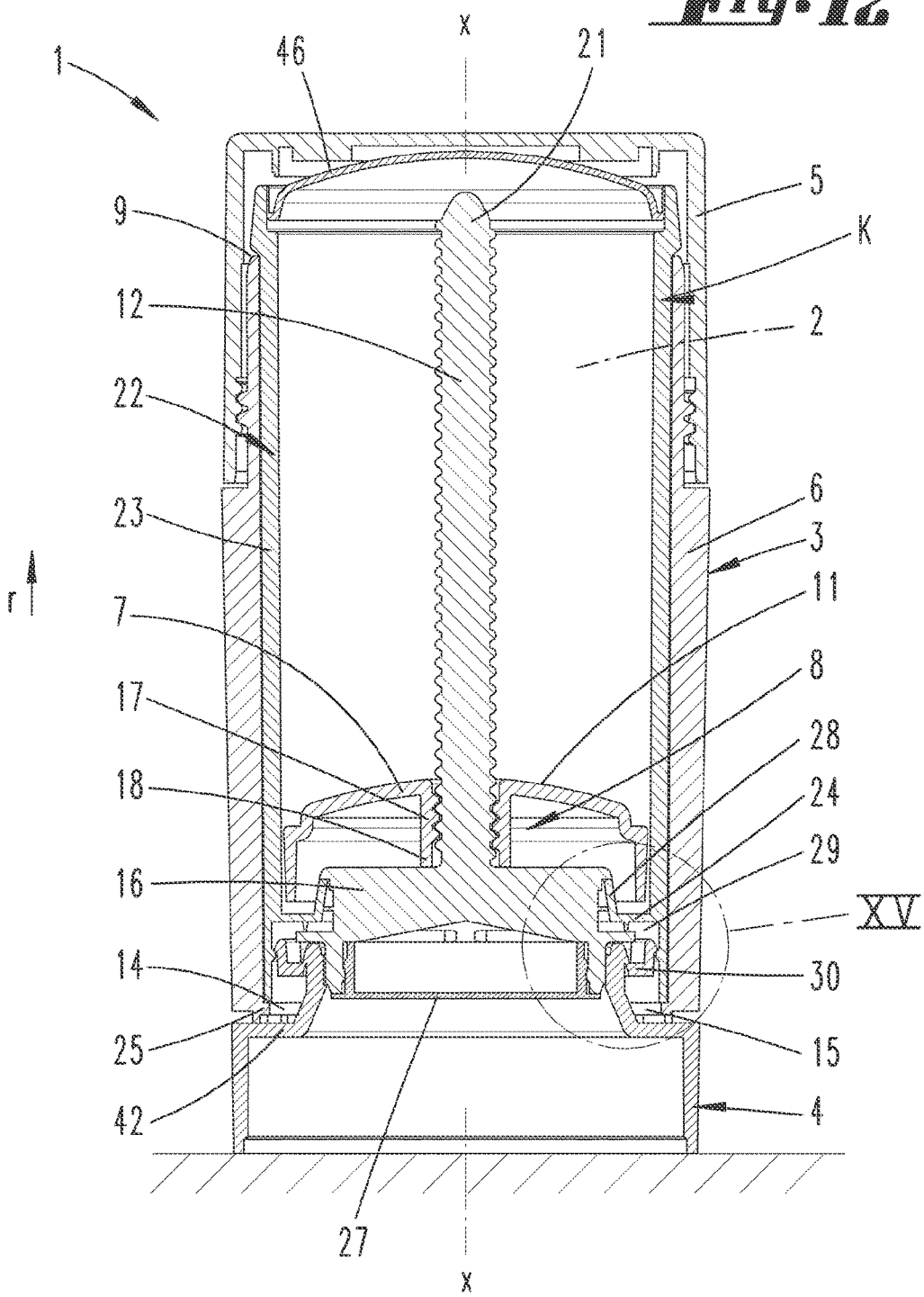
FIG. 12 shows a longitudinal section through a device according to a fifth embodiment.
Figure 13:
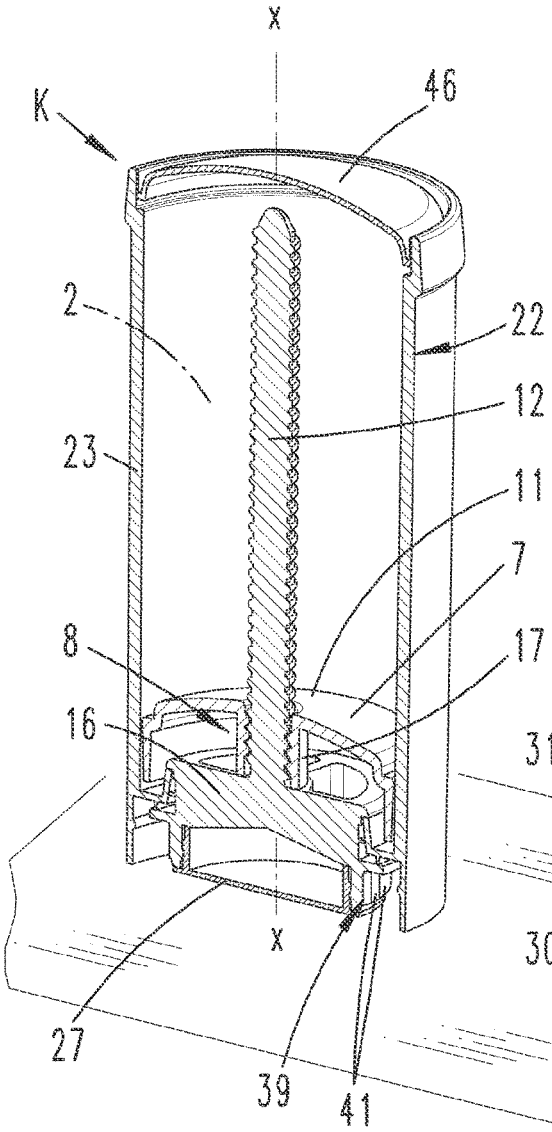
FIG. 13 shows a sectioned perspective view of a combination for being inserted into a device according to FIG. 12.
Figure 14:
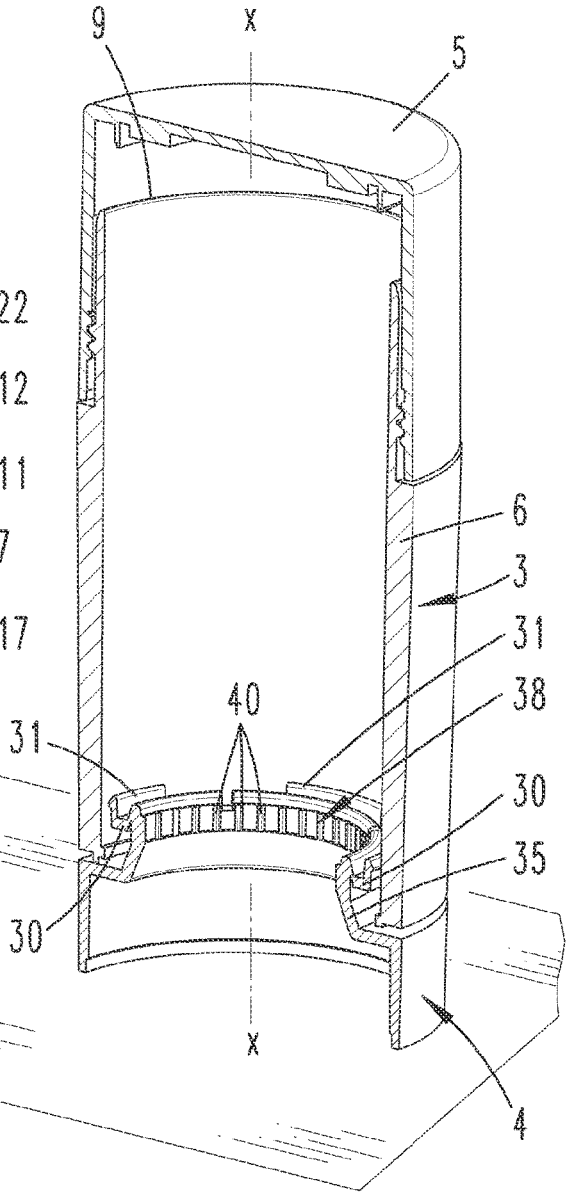
FIG. 14 shows a sectioned perspective view of the device housing of the device according to FIG. 12.
Figure 15:
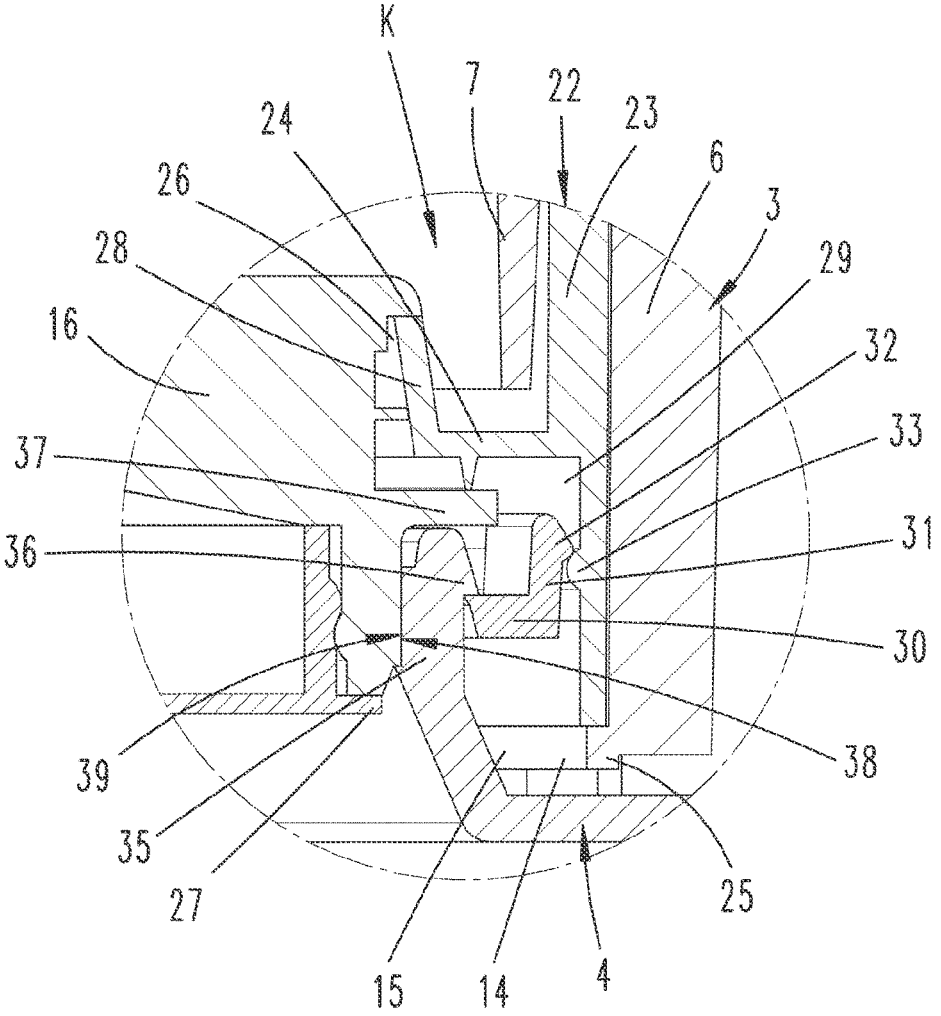
FIG. 15 shows an enlarged detail of the region XV in FIG. 12.
Figure 16:
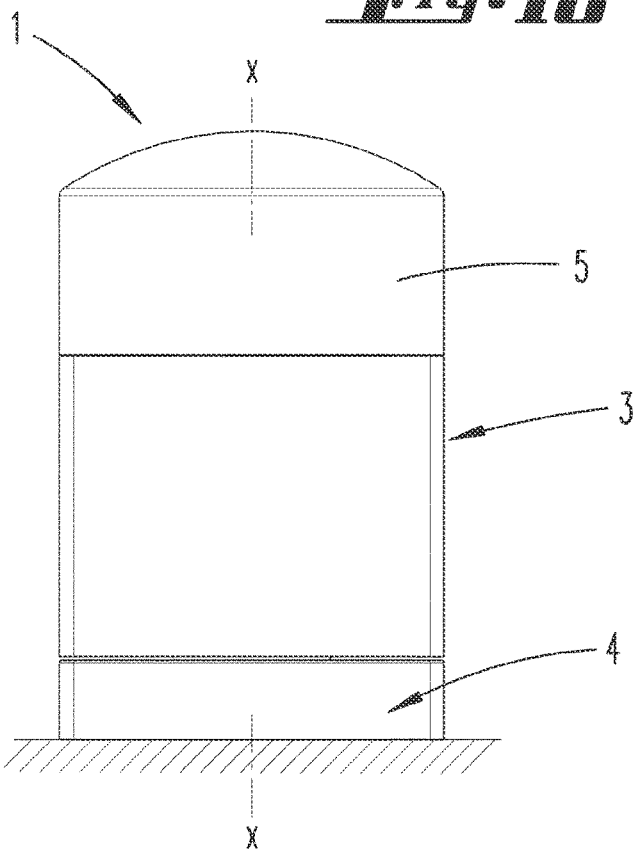
FIG. 16 shows another embodiment of the device.
Figure 17:
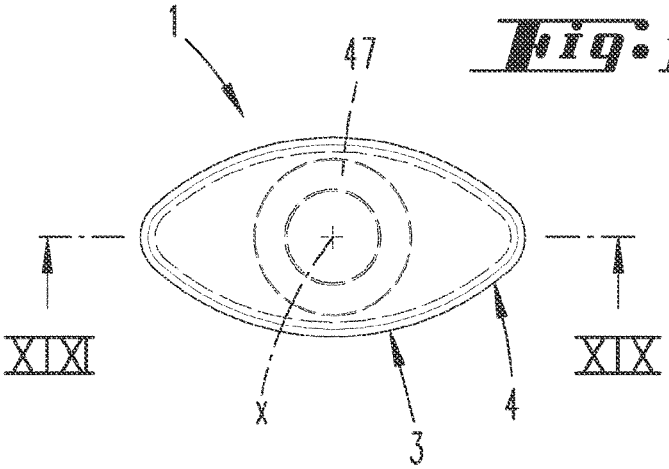
FIG. 17 shows a bottom view of the device according to FIG. 16.
Figure 18:
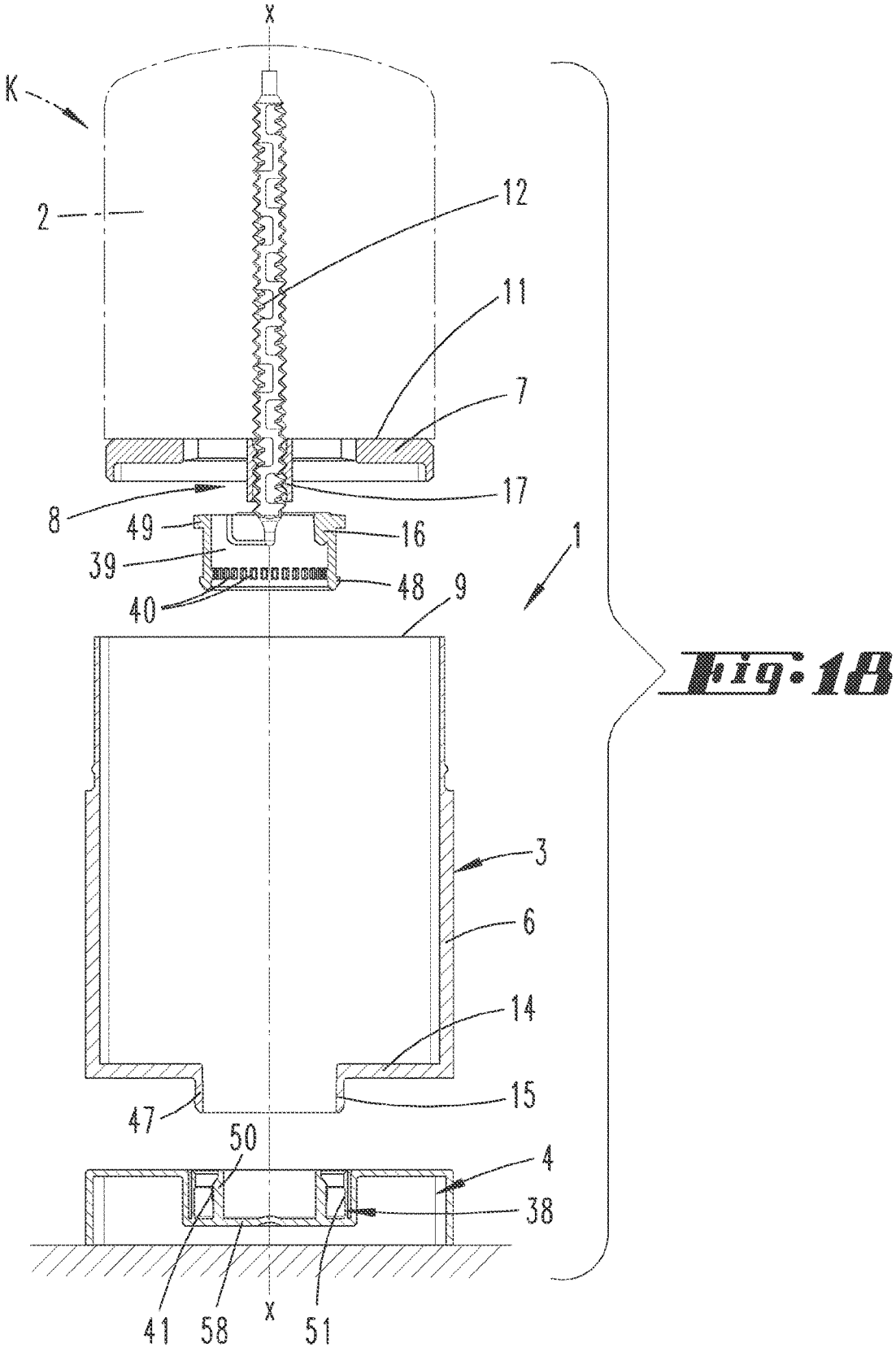
FIG. 18 shows a sectioned exploded view of the device according to FIG. 16.

The section in FIG. 9, in particular, shows that two such depressions 44 and elevations 45 essentially may be provided diametrically opposite of one another.

The interlock resulting from the engagement of the elevation 45 into the depression 44 can be very easily overrun by means of an intentional rotational movement of the rotary handle 4.

In order to remove a combination K with optionally depleted compound 2 from the device housing 3, it is merely required to exert pressure upon the spindle 12 along the longitudinal axis x in the moving direction r, which is facilitated due to the open-bottom design of the rotary handle 4, in order to thereby particularly overcome the interlock between the inner housing 22 and the device housing 3 and to transport the combination K out of the device housing 3 along the longitudinal axis x. The coupling between the outer coupling part 38 and the inner coupling part 39 is simultaneously disengaged.

The combination K, particularly in the form of an unused replacement part, essentially can be designed in an all-around closed manner due to the arrangement of an inner housing 22. In the unused state, in particular, a film-like seal 46 may cover the compound 2, e.g. in the form of a spherical cap, in the region of the housing opening 9 resulting from the inner housing 22 (compare, for example, to FIGS. 8 and 12). Such a seal. 46 can serve as quality assurance, but furthermore also as a bottom for filling the inner housing 22 with compound 2 in an overhead position in the course of the manufacture of the combination K.

In the sixth embodiment of the device 1 illustrated in FIGS. 16 to 20, the rotary handle 4 likewise accommodates the oval contour of the outline of the device housing 3.

The housing bottom 14 forms a downwardly directed and concentrically extending fastening wall 47 circumferentially to the central through-hole 15, wherein one or more circumferentially distributed interlocking tabs 48, which are arranged on the spindle base 16 and directed radially outward, engage in the inserted position of the combination K into the device housing 3 underneath the downwardly directed circumferential edge surface of said fastening wall in order to fix the combination K in the device housing 3 in an interlocking manner (compare particularly to FIG. 20). It is furthermore preferred that the spindle base 16 is supported on the upper side of the housing bottom 14 with a radial collar 49 in this interlocked position.

The pot-shaped section of the spindle base 16, which carries the interlocking tab 48 that is directed radially outward, forms the outer coupling part 38 on the inner wall side facing radially inward.

The rotary handle 4 is attached from the underside after inserting the combination K into the device housing 3 and producing the above-described interlock. A central circumferential wall 50 of the rotary handle 4 forms the inner coupling part 39, which is directed radially outward and serves for producing the rotationally fixed coupling with the spindle 12.

The rotary handle 4 may have a sealing wall 51, which is axially oriented in the same direction to the wall 50, concentric to the aforementioned wall 50 and offset radially outward, wherein said sealing wall can move against the fastening wall 47 of the device housing 3 in a sealing manner from radially outside in the position, in which the rotary handle 4 is respectively arranged on the device housing 3 or on the spindle 12 (compare to FIG. 20). A seal between the device housing 3 and the rotary handle 4 is thereby produced.

In the seventh embodiment of the device 1 illustrated in FIGS. 21 to 26, the outline of the device as a whole essentially may be realized with an oval contour, wherein the rotary handle 4 preferably has an essentially circular outline and its circumferential surface is in accordance with the first embodiments (FIGS. 1 to 5) partially exposed on the longitudinal side of the device housing 3 in the region of window-like recesses 52 provided on the bottom side in order to be rotationally actuated.

The interlock of the combination K in the device housing 3, which allows the rotatability of the spindle 12, is in this embodiment preferably achieved due to the interlocking engagement of the outer edge surrounding the through-hole 15 in the housing bottom 14 into a groove 53 that is formed on the spindle base 16 concentric to the longitudinal axis x and open radially outward.

In this case, the through-hole 15 is formed in a section of the housing bottom 14 that preferably is drawn-in inward with respect to the device housing 3. The drawn-in section may be designed in a pot-like or dome-like manner, wherein a part of the pot bottom is in a pot-like design removed in order to form the through-hole 15. On the other hand, the through-hole 15 is with respect to a dome-like opening preferably realized in the form of a central opening in the dome-like design.

It is altogether preferred that the pedestal base 16 is underneath the groove 53 designed in a pot-like manner with a circumferential retaining wall 54 that extends into the central and downwardly open space resulting from the pot-like, drawn-in design of the housing bottom 14. This retaining wall 54 forms an interlocking back engagement 55, which is directed radially inward, for engaging behind an interlocking tab 56 of the rotary handle 4.

In the inserted position of the combination K, a plug-in wall 57 of the device housing 3, which circumferentially extends concentric to the longitudinal axis x, extends on the underside of the pot-like, drawn-in section of the housing bottom 14 at a radial distance from the retaining wall 54.

Furthermore, the retaining wall 54 of the spindle base 16 forms the outer coupling part 58 according to the above-described exemplary embodiments, which is directed radially inward.

The altogether pot-shaped rotary handle 4 may have a handle bottom 58, which in the assigned position essentially extends in the positioning plane of the device 1 defined by the housing bottom 14. A radially inner handle wall 59 may extend in preferably concentric arrangement starting from this handle bottom 58 and a sealing wall 51 may extend such that it is spaced apart radially outward from this handle wall.

In the position, in which the rotary handle 4 is arranged on the spindle 12, the sealing wall 51 can abut on the plug-in wall 57 of the device housing 3 in a sealing manner such that a radially inner seal between the rotary handle 4 and the device housing 3 is achieved (compare to FIGS. 25 and 26).

The radially inner handle wall 59 may on its end to carry one or more interlocking tabs 56 that can interact with the interlocking back engagement 55 of the spindle 12 or the spindle base 16 in an interlocking manner.

Furthermore, the handle wall 59 may form the inner coupling part 39 that is directed radially outward and serves for producing the rotationally fixed coupling between the rotary handle 4 and the spindle 12.

Figure 19:
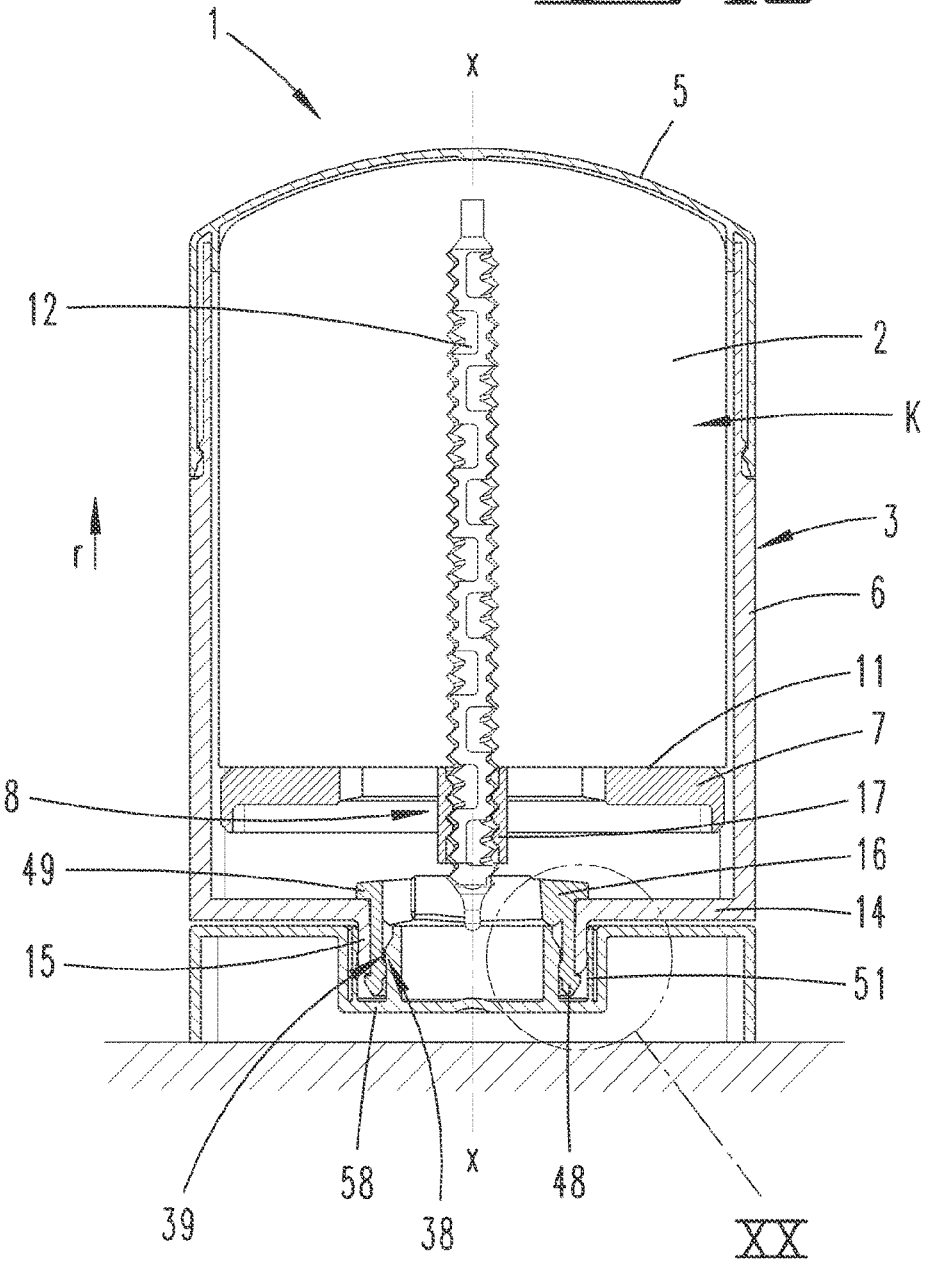
FIG. 19 shows the device according to FIG. 16 in the form of a longitudinal section.

The illustrations in FIGS. 19 (sixth embodiment) and 22 (seventh embodiment), in particular, furthermore show that the spindle 12 may, e.g. in order to save material, only have a partial external thread formation in the circumferential direction, preferably in two diametrically opposite regions, wherein said opposite segment-shaped threaded regions may with respect to a cross section, in which the longitudinal axis x is illustrated in the form of a point, be connected by chord-like straight lines extending parallel to one another on the respective ends of their circumferential extent.

The preceding explanations serve for elucidating all inventions that are included in this application and respectively enhance the prior art independently with at least the following combinations of characteristics, wherein two, multiple or all of these combinations of characteristics may also be combined with one another, namely:

A device, which is characterized in that the spindle nut 17 has in the direction of the longitudinal axis x a length b that is equal to or greater than the distance a between the lower starting position and the maximally extended upper position in the moving direction r of the support 7.

A device, which is characterized in that the spindle nut 17 is realized in the form of an elongate sleeve 18 that downwardly protrudes beyond the support 7 opposite to the moving direction r by a length c corresponding to a multiple of the spindle outside diameter d.

A device, which is characterized in that the lower starting position is defined by an abutment of an upper end 20 of the spindle nut 17 on the spindle 12.

A device, which is characterized in that the lower starting position is defined by an abutment of the lower end 19 of the spindle nut 17 on the spindle 12, optionally on a spindle base 16.

A device, which is characterized in that the support 7 has a central region 10, which is assigned to the spindle nut 17 and/or the spindle 12.

A device, which is characterized in that the central region 10 is designed in a closed manner.

A device, which is characterized in that the surface 11 of the support 7 assigned to the compound 2 is designed in a completely closed manner.

A device, which is characterized in that the spindle nut 17 is closed on its face side.

A device, which is characterized in that the spindle nut 17 upwardly protrudes beyond the central region 10 of the support 7 in the moving direction r of the support 7.

A device, which is characterized in that a combination K consisting of the support 7, the spindle 12 and the compound 2 can be inserted into the device housing 3 from above in order to be connected to the rotary handle 4.

A device, which is characterized in that the spindle 12 and the support 7 are accommodated in an inner housing 22 that is realized separately of the device housing 3.

A device, which is characterized in that the rotary handle 4 has an outer coupling part 38 and the spindle 12 has an inner coupling part 39.

A device, which is characterized in that the rotary handle 4 has an inner coupling part 39 and the spindle 12 has an outer coupling part 38.

A device, which is characterized in that the lower surface 43 has one or more interlocking formations 44, which interact with one or more mating interlocking formations 45 of the rotary handle 4, and in that a circumferentially extending annular region 61, on which the housing bottom 14 and the rotary handle 4 can directly abut on one another, is formed at least radially inside of an interlocking formation 44.

A device, which is characterized in that a circumferentially extending annular region 62, on which the housing bottom 14 and the rotary handle 4 can directly abut on one another, is formed radially outside of an interlocking formation 44.

A device, which is characterized in that two interlocking formations 44 are provided on the lower surface 43 of the housing bottom 14 and two mating interlocking formations 45 are provided on the rotary handle 4.

A device, which is characterized in that the interlocking formations 44 and the mating interlocking formations 45 respectively are arranged diametrically opposite of one another with respect to the longitudinal axis x.

All disclosed characteristics are essential to the invention (individually, but also in combination with one another). The disclosure of the associated/attached priority documents (copy of the priority application) is hereby fully incorporated into the disclosure content of this application, namely also for the purpose of integrating characteristics of these documents into claims of the present application. The characteristics of the dependent claims also characterize independent inventive enhancements of the prior art without the characteristics of a claim to which they refer, particularly for submitting divisional applications on the basis of these claims. The invention specified in each claim may additionally comprise one or more of the characteristics that were disclosed in the preceding description and, in particular, are identified by reference symbols and/or included in the list of reference symbols. The invention also concerns design variations, in which individual characteristics cited in the preceding description are not realized, particularly as far as they are obviously dispensable for the respective intended use or can be replaced with other, identically acting technical means.

LIST OF REFERENCE SYMBOLS

1 Device
2 Compound
3 Device housing
4 Rotary handle
5 Covering cap
6 Wall
7 Support
8 Moving arrangement
9 Housing opening
10 Central region
11 Surface
12 Spindle
13 Receptacle
14 Housing bottom
15 Through-hole
16 Spindle base
17 Spindle nut
18 Sleeve
19 Lower end
20 Upper end
21 Spindle end
22 Inner housing
23 Wall
24 Inner housing bottom
25 Stop shoulder
26 Through-hole
27 Plug
28 Collar
29 Space
30 Retaining pedestal
31 Interlocking web
32 Interlocking tab
33 Mating interlock
34 Opening
35 Retaining wall
36 Interlocking projection
37 Shoulder
38 Outer coupling part
39 Inner coupling part
40 Rib
41 Receptacle

42 Ceiling
43 Lower surface
44 Interlocking recess
45 Mating interlocking formation
46 Seal
47 Fastening wall
48 Interlocking tab
49 Radial collar
50 Wall
51 Sealing wall
52 Recess
53 Groove
54 Retaining wall
55 Interlocking back engagement
56 Interlocking tab
57 Plug-in wall
58 Handle bottom
59 Handle wall
60 Cap
61 Region
62 Region
63 Lip
a Distance
b, b' Length
c Length
d Diameter
e Extending dimension
f Extending dimension
g Outside diameter
h Height
r Moving direction
x Longitudinal axis
K Combination

The invention claimed is:

1. A device (1) for dispensing a compound (2), wherein a movable support (7) is arranged in a device housing (3) in order to act upon the compound (2), wherein a rotary handle (4) furthermore is provided in order to move the support (7) between a lower starting position and a maximally extended upper position of the support (7), wherein said rotary handle has a spindle (12) that is rotatable about a longitudinal axis (x) extending in the moving direction (r) of the support (7), wherein a spindle nut (17) furthermore is provided on the support (7), wherein the spindle nut (17) furthermore has in the direction of the longitudinal axis (x) a length (b) that is equal to or greater than the distance (a) between the lower starting position and the maximally extended upper position in the moving direction (r) of the support (7), wherein the spindle nut (17) is realized in the form of an elongate sleeve (18) that downwardly protrudes beyond the support (7) opposite to the moving direction (r) by a length (c) corresponding to a multiple of the spindle outside diameter (d), and wherein the support (7) has a central region (10), which is assigned to the spindle nut (17) and/or the spindle (12), wherein the spindle nut (17) is closed on its face side, and wherein the spindle nut (17) upwardly protrudes beyond the central region (10) of the support (7) in the moving direction (r) of the support (7).

2. A device (1) for dispensing a compound (2), wherein a movable support (7) is arranged in a device housing (3) in order to act upon the compound (2), wherein a rotary handle (4) furthermore is provided in order to move the support (7) between a lower starting position and a maximally extended upper position of the support (7), wherein said rotary handle has a spindle (12) that is rotatable about a longitudinal axis (x) extending in the moving direction (r) of the support (7), and wherein a spindle nut (17) furthermore is provided on the support (7), wherein a combination (K) consisting of the support (7) and the compound (2) arranged thereon, as well as the spindle (12), is provided for replenishing consumed compound (2), wherein the combination (K) additionally comprises an inner housing (22), and wherein a wall (23) of the inner housing (22) furthermore directly surrounds the support (7) with the compound supported thereon, wherein the combination (K) inserted into the device housing (3) from above encounters a stop limitation in the inserted position, wherein the inner housing (22) abuts on a section of the housing bottom (14) in a stop-limiting manner, wherein the spindle (12) is in the inserted position guided so as to be rotatable about the longitudinal axis (x) by means of its spindle base (16) in the region of a central through-hole (26) in the inner housing bottom (24), wherein the spindle base (16) furthermore has a downwardly directed circular pot shape underneath the inner housing bottom (24), wherein a retaining pedestal (30), which is connected to the device housing (3), is arranged in a space (29) underneath the inner housing bottom (24), wherein the retaining pedestal (30) furthermore is sectionally fastened on the inner side of the wall (6) of the device housing (3) in the circumferential direction, and wherein an interlocking web (31) extending in the direction of the longitudinal axis (x) extends in the sections resulting between the fastening regions of the retaining pedestal (30) in the circumferential direction at a radial distance from the wall (6) of the device housing (3) in order to form a passage for the foot section of the inner housing wall (23) extending underneath the inner housing bottom (24) in the inserted position of the combination (K), wherein the interlocking web (31) of the retaining pedestal (30) has an outwardly directed interlocking tab (32) for interacting with an inwardly directed mating interlock (33) on the inner housing wall (23) in an interlocking manner in the stop-limited inserted position of the combination (K) into the device housing (3) in order to retain the combination (K) in the device housing (3) in an interlocking manner by means of the inner housing (22).

3. The device according to claim 2, wherein a combination (K) consisting of the support (7), the spindle (12) and the compound (2) can be inserted into the device housing (3) from above in order to be connected to the rotary handle (4), and wherein the housing bottom (14) forms a downwardly directed fastening wall (47), which circumferentially extends concentric to the central through-hole (15), wherein one or more circumferentially distributed interlocking tabs (48), which are arranged on the spindle base (16) and directed radially outward, engage underneath the downwardly directed circumferential edge surface of said fastening wall in the inserted position of the combination (K) into the device housing (3) in order to fix the combination (K) in the device housing (3) in an interlocking manner.

4. The device according to claim 2, wherein a combination (K) consisting of the support (7), the spindle (12) and the compound (2) can be inserted into the device housing (3) from above in order to be connected to the rotary handle (4), and wherein the interlock of the combination (K) in the device housing (3), which allows the rotatability of the spindle (12), is achieved due to the interlocking engagement of the outer edge surrounding the through-hole (15) in the housing bottom (14) into a groove (53) that is formed on the spindle base (16) concentric to the longitudinal axis (x) and open radially outward.

5. The device according to claim 1, wherein the central region (10) is designed in a closed manner.

6. The device according to claim 1, wherein the surface (11) of the support (7) assigned to the compound (2) is designed in a completely closed manner.

7. The device according to claim 2, wherein a combination (K) consisting of the support (7), the spindle (12) and the compound (2) can be inserted into the device housing (3) from above in order to be connected to the rotary handle (4), wherein the spindle (12) and the support (7) are accommodated in an inner housing (22) that is realized separately of the device housing (3), wherein the rotary handle (4) has an outer coupling part (38) and the spindle (12) has an inner coupling part (39) or wherein the rotary handle (4) has an inner coupling part (39) and the spindle (12) has an outer coupling part (38), wherein the rotary handle (4) forms the outer coupling part (38), which is directed radially inward and interacts with the inner coupling part (39) of the spindle (12), in the region of its retaining wall (35), and wherein the inner coupling part (39) is formed on the outer side of the circumferential pot-shaped wall of the spindle (16) extending underneath the inner housing bottom (24) such that it is directed radially outward or wherein the inner coupling part (39) is formed on the rotary handle (4) and the outer coupling part (38) is formed on the spindle (12), wherein the outer coupling part (38) and the inner coupling part (39) only interact in a form-fitting manner in the circumferential direction by means of radially protruding ribs (40), which are uniformly distributed over the circumference on one of the two coupling parts (38, 39) and aligned in the direction of the longitudinal axis (x), and wherein said ribs can engage into a correspondingly positioned slot-shaped receptacles (41) of the other coupling part in a form-fitting manner.

8. A device (1) for dispensing a compound (2), wherein a movable support (7) is arranged in a device housing (3) in order to act upon the compound (2), wherein a rotary handle (4) furthermore is provided in order to move the support (7) between a lower starting position and a maximally extended upper position of the support (7), wherein said rotary handle has a spindle (12) that is rotatable about a longitudinal axis (x) extending in the moving direction (r) of the support (7), wherein a housing bottom (14) furthermore is formed on the device housing (3) and the rotary handle (4) interacts with the housing bottom (14) in an interlocking yet overrunable manner in order to stably maintain a rotational position, and wherein the housing bottom (14) furthermore has a lower surface (43), wherein the lower surface (43) has one or more interlocking formations (44), which interact with one or more mating interlocking formations (45) of the rotary handle (4), wherein a region (61), which circumferentially extends in an annular manner and on which the housing bottom (14) and the rotary handle (4) can directly abut on one another, is formed at least radially inside of an interlocking formation (44) and a region (62), which circumferentially extends in an annular manner and on which the housing bottom (14) and the rotary handle (4) can directly abut on one another, is formed radially outside of an interlocking formation (44).

9. The device according to claim 8, wherein two interlocking formations (44) are provided on the lower surface (43) of the housing bottom (14) and two mating interlocking formations (45) are provided on the rotary handle (4).

10. The device according to claim 8, wherein the interlocking formations (44) and the mating interlocking formations (45) respectively are arranged diametrically opposite of one another with respect to the longitudinal axis (x).

* * * * *